US007454901B2

(12) United States Patent
Kato et al.

(10) Patent No.: US 7,454,901 B2
(45) Date of Patent: Nov. 25, 2008

(54) EXHAUST SYSTEM, AND ENGINE DEVICE AND VEHICLE WITH THE SAME

(75) Inventors: Ryusuke Kato, Shizuoka (JP); Masaki Torigoshi, Shizuoka (JP); Akira Ishizaki, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 47 days.

(21) Appl. No.: 11/462,291

(22) Filed: Aug. 3, 2006

(65) Prior Publication Data

US 2007/0028906 A1 Feb. 8, 2007

(30) Foreign Application Priority Data

Aug. 5, 2005 (JP) ..... 2005-228551

(51) Int. Cl.
*F01N 7/00* (2006.01)

(52) U.S. Cl. ..... 60/324; 60/276; 60/285; 60/305; 60/313; 60/323

(58) Field of Classification Search ..... 60/274, 60/276, 285, 305, 311, 312, 313, 323, 324
See application file for complete search history.

(56) References Cited

U.S. PATENT DOCUMENTS 4,261,170 A 4/1981 Suzuki
4,745,742 A * 5/1988 Nada et al. ..... 60/276
5,226,921 A * 7/1993 Leistritz ..... 123/703
5,271,477 A * 12/1993 Gekka et al. ..... 180/219
5,365,735 A * 11/1994 Weber et al. ..... 60/323
5,613,480 A 3/1997 Katoh et al.
6,082,103 A * 7/2000 Sugiura et al. ..... 60/323
6,722,126 B2 * 4/2004 Kawamizu ..... 60/324

(Continued)

FOREIGN PATENT DOCUMENTS

EP 0744537 A1 11/1996

(Continued)

OTHER PUBLICATIONS

Kato et al., "Exhaust System, and Engine Device and Vehicle With the Same," U.S. Appl. No. 11/419,088, filed May 18, 2006.

(Continued)

*Primary Examiner*—Binh Q Tran
(74) *Attorney, Agent, or Firm*—Keating & Bennett, LLP

(57) ABSTRACT

In an exhaust system, a first oxygen sensor is attached to an exhaust pipe connected to a standard cylinder in which the amount of injected fuel is the closest to the average of the amounts of fuel injected in a plurality of cylinders. A controller calculates the air-fuel ratio of the standard cylinder based on the value detected by the first oxygen sensor. Then, based on the difference between the calculated air-fuel ratio of the standard cylinder and a predetermined target air-fuel ratio, the amount of correction to the amount of fuel injected in the standard cylinder is determined such that the air-fuel ratio of the standard cylinder is equal to the target air-fuel ratio. Furthermore, based on the amount of correction to the amount of fuel injected in the standard cylinder, the amounts of correction of the other cylinders are determined.

8 Claims, 19 Drawing Sheets

U.S. PATENT DOCUMENTS

| | | | | |
|---|---|---|---|---|
| 6,925,862 | B2 * | 8/2005 | Fujita et al. | 73/118.1 |
| 7,171,804 | B2 * | 2/2007 | Terashima | 60/323 |
| 2002/0069643 | A1 | 6/2002 | Yoshizawa et al. | |
| 2003/0154714 | A1 | 8/2003 | Ito | |

FOREIGN PATENT DOCUMENTS

| | | | |
|---|---|---|---|
| EP | 1118750 | A1 | 7/2001 |
| GB | 2238918 | A | 12/2003 |
| JP | 58-28532 | A | 2/1983 |
| JP | 58-98639 | A | 6/1983 |
| JP | 58-128427 | A | 8/1983 |
| JP | 09-280039 | A | 10/1997 |
| JP | 2001-241323 | A | 9/2001 |
| JP | 3242488 | B2 | 10/2001 |
| JP | 2002-235540 | A | 8/2002 |
| JP | 2002-309930 | A | 10/2002 |
| JP | 2004-278401 | A | 10/2004 |
| JP | 2004-308443 | A | 11/2004 |

OTHER PUBLICATIONS

Official communication issued in the counterpart European Application No. 06016454.8, mailed on Mar. 30, 2007.

* cited by examiner

EXHAUST SYSTEM, AND ENGINE DEVICE AND VEHICLE WITH THE SAME

BACKGROUND OF THE INVENTION

1. Field of the Invention

The present invention relates to an exhaust system that exhausts exhaust gas from an engine, and an engine device and a vehicle with the same.

2. Description of the Related Art

Conventionally, a catalyst device has been provided in an exhaust system to remove harmful substances contained in the exhaust gas emitted from an engine.

In order to quickly activate the catalyst device, the temperature of the catalyst needs to be rapidly increased in a short period of time. Consequently, there has been developed an exhaust system in which the catalyst device is arranged closer to the engine so that high temperature exhaust gas flows into the catalyst.

For example, in an exhaust system including a catalyst provided in a motorcycle described in JP 3242488 B, auxiliary oxidation catalysts are provided in a front exhaust pipe and a rear exhaust pipe connected to a front cylinder and a rear cylinder of a V-type two cylinder engine. However, in the configuration described in JP 3242488 B, the auxiliary oxidation catalysts need to be increased in number with an increase in the number of the cylinders of the engine, which increases the manufacturing cost.

As a method to solve such a problem, there is a method in which exhaust pipes of a plurality of cylinders are merged into one exhaust pipe and a catalyst device is provided at this portion where the exhaust pipes are merged. This can reduce the number of catalyst devices to be installed.

For example, in an exhaust treatment device of the exhaust gas of an internal combustion engine described in JP 2001-241323 A, exhaust pipes of first and third cylinders, in the order of ignition, are merged into one chamber to cause the exhaust gas to flow into a catalyst device through this chamber. Furthermore, exhaust pipes of second and fourth cylinders, in the order of ignition, are merged into the other chamber to cause the exhaust gas to flow into a catalyst device from this chamber.

Meanwhile, purification efficiency of the catalyst is significantly influenced by the air-fuel ratio of the engine. Therefore, in a conventional exhaust system, for example, oxygen sensors are arranged in the exhaust pipes so that components of the exhaust gas are detected. Based on the result of detection by the oxygen sensors, an optimization control is then applied to the air-fuel ratio of the engine, and a decrease in the purification efficiency of the catalyst is thus prevented.

However, in the exhaust system with a plurality of inflow portions of the exhaust gas to the catalyst device as described in JP 2001-241323 A, in order to detect the components of the exhaust gas exhausted from the respective cylinders of the engine with high accuracy, the oxygen sensors need to be provided in the inflow portions, respectively. For example, in the exhaust treatment device of the exhaust gas of the internal combustion engine described in JP 2001-241323 A, the oxygen sensors need to be provided in two chambers, respectively. In this case, the manufacturing cost is increased due to provision of a plurality of oxygen sensors.

SUMMARY OF THE INVENTION

In order to overcome the problems described above, preferred embodiments of the present invention provide a low-cost exhaust system that can enhance purification efficiency of a catalyst, and an engine device and a vehicle with the same.

An exhaust system according to a preferred embodiment of the present invention is an exhaust system that exhausts gas from a plurality of cylinders of an engine, including a same number of first exhaust pipes as the plurality of cylinders into which the gas exhausted from the plurality of cylinders flows, respectively, a first catalyst device having a first catalyst that cleanses the gas introduced through the plurality of first exhaust pipes, a first assembler that assembles first ends of the plurality of first exhaust pipes and couples the first ends to one end of the first catalyst device, a plurality of first inflow portions provided at the first assembler that allow the gas exhausted from the plurality of first exhaust pipes to flow into the first catalyst device, a first detector provided in any one of the plurality of first exhaust pipes or any one of the plurality of first inflow portions and arranged to detect the information about oxygen concentration of the gas exhausted from a respective one of the plurality of cylinders, and a controller that controls the amount of injected fuel in the plurality of cylinders, based on the information about the oxygen concentration detected by the first detector, wherein the first assembler is connected to the first catalyst device such that the plurality of first inflow portions are not in communication with each other.

In the exhaust system of this preferred embodiment of the present invention, the gas exhausted from the plurality of cylinders of the engine flows into the plurality of first exhaust pipes, respectively. The gas flowing into the plurality of the first exhaust pipes flows into the first catalyst device through the plurality of first inflow portions of the first assembler and is cleansed by the first catalyst.

The first detector that is provided in any one of the plurality of first exhaust pipes or any one of the plurality of first inflow portions detects the information about the oxygen concentration of the gas. The controller controls the amounts of injected fuel in the plurality of cylinders based on the information about the oxygen concentration detected by the first detector.

In this case, the first detector is provided in any one of the plurality of first exhaust pipes or any one of the plurality of first inflow portions, thereby making it possible to control the amounts of injected fuel in all of the cylinders based on the information about the oxygen concentration detected by the first detector such that the first catalyst can efficiently achieve its cleansing performance.

In this way, since the need to detect the information about the oxygen concentration in each cylinder is eliminated and the amounts of injected fuel in all of the cylinders can be determined based on the information about the oxygen concentration in any one of the cylinders, it is not necessary to provide a same number of the first detectors as those of the cylinders. This enables the purification efficiency of the first catalyst to be improved at low cost.

Furthermore, the first assembler is connected to the first catalyst device such that the plurality of first inflow portions are not in communication with each other. In this case, the gases introduced through the plurality of first exhaust pipes are prevented from interfering with one another in the first assembler when the gases flow into the first catalyst device from the first inflow portions. Accordingly, even if the first catalyst device is arranged close to the engine in order to cause the high temperature gas to flow into the first catalyst, a reduction in the output performance of the engine due to pressure interference of the gas can be prevented.

The first exhaust pipe or the first inflow portion provided with the first detector may be connected to the cylinder in which the amount of injected fuel is the closest to an average of the amounts of fuel injected in the plurality of cylinders.

In this case, since the amounts of injected fuel in all of the cylinders are controlled based on the information about the oxygen concentration of the gas exhausted from the cylinder in which the amount of injected fuel is the closest to the average of the amounts of injected fuel in the plurality of cylinders, errors in the amount of injected fuel in the respective cylinders can be significantly reduced and minimized.

The controller may calculate the air-fuel ratio in the cylinder in which the amount of injected fuel is the closest to the average amount based on the information about the oxygen concentration detected by the first detector, and may control the amounts of fuel injected in the plurality of cylinders based on the difference between the calculated air-fuel ratio and a predetermined target air-fuel ratio.

In this case, since the amounts of injected fuel are controlled based on the difference between the air-fuel ratio of the cylinder in which the amount of injected fuel is the closest to the average of the amounts of injected fuel in the plurality of cylinders and the predetermined target air-fuel ratio, it is possible to easily bring the air-fuel ratio of the plurality of cylinders closer to the target air-fuel ratio. This makes it possible to reliably improve the purification efficiency of the first catalyst.

The controller may determine a standard amount of fuel injected in each of the plurality of cylinders based on the predetermined target air-fuel ratio, and may determine an amount of correction to the standard amount of fuel injected in the cylinder in which the amount of injected fuel is the closest to the average amount is based on the difference between the calculated air-fuel ratio and the predetermined target air-fuel ratio such that the air-fuel ratio of the cylinder in which the amount of injected fuel is the closest to the average amount is equal to the predetermined target air-fuel ratio.

In the exhaust system of this preferred embodiment of the present invention, the controller first determines the standard amounts of injected fuel in the respective cylinders based on the predetermined target air-fuel ratio. Then, based on the information about the oxygen concentration detected by the first detector, the air-fuel ratio of the cylinder in which the amount of injected fuel is the closest to the average of the amounts of injected fuel in the plurality of cylinders is calculated, and based on the difference between the calculated air-fuel ratio and the predetermined target air-fuel ratio, the amount of correction to the standard amount of injected fuel in that cylinder is determined such that the air-fuel ratio of that cylinder is equal to the predetermined target air-fuel ratio. Furthermore, based on that amount of correction, the controller can determine the amounts of correction to the standard amounts of injected fuel in the other cylinder or cylinders.

In this case, since the standard amount of injected fuel is determined based on the predetermined target air-fuel ratio and the amount of correction to that standard amount of injected fuel is determined, it is possible to reliably bring the air-fuel ratio of each of the cylinders closer to the target air-fuel ratio. Thus, the purification efficiency of the first catalyst can be reliably improved.

The controller may determine the amount of correction to the standard amount of injected fuel in at least one of the other cylinders based on the determined amount of correction to the standard amount of fuel injected in the cylinder in which the amount of injected fuel is the closest to the average amount. In this case, it is possible to easily and reliably bring the air-fuel ratio of each of the cylinders closer to the target air-fuel ratio.

The exhaust system may further include a plurality of second exhaust pipes corresponding in number to the plurality of cylinders, and a second assembler arranged to assemble and couple first ends of the plurality of second exhaust pipes to the first catalyst device, wherein the plurality of first inflow portions of the first assembler corresponds in number to the plurality of first exhaust pipes, the second assembler may have a plurality of second inflow portions corresponding in number to the plurality of second exhaust pipes, and the second assembler may be connected to the first catalyst device such that the plurality of second inflow portions are not in communication with one another, and the plurality of second inflow portions may be arranged so as to be opposed to the plurality of first inflow portions, respectively, with the first catalyst device interposed therebetween.

In the exhaust system of this preferred embodiment of the present invention, the gas exhausted from the plurality of cylinders of the engine flows into the plurality of first exhaust pipes, respectively. The gas flowing into the plurality of first exhaust pipes flows into the first catalyst device through the plurality of first inflow portions of the first assembler, respectively. The gas cleansed in the first catalyst device flows into the plurality of second exhaust pipes through the plurality of second inflow portions of the second assembler, respectively.

The first assembler is connected to the first catalyst device such that the plurality of first inflow portions are not in communication with each other. The second assembler is connected to the first catalyst device such that the plurality of second inflow portions are not in communication with each other. The plurality of second inflow portions are arranged so as to be opposed to the plurality of first inflow portions, respectively, with the first catalyst device interposed therebetween.

In this case, the gas flowing into the first catalyst device through the respective first inflow portions passes through the first catalyst device and then flows into the second inflow portions arranged at the opposed positions. Here, since the plurality of first inflow portions are not in communication with each other, the gases introduced through the plurality of first exhaust pipes are prevented from interfering with one another in the first assembler when the gases flow into the first catalyst device from the first inflow portions. Furthermore, since the plurality of second inflow portions are not in communication with each other, the gases introduced through the plurality of first exhaust pipes are prevented from interfering with one another in the second assembler when the gases flow into the second inflow portions from the first catalyst device. Accordingly, even if the first catalyst device is arranged close to the engine in order to cause the high temperature gas to flow into the first catalyst, the pressure interference of the gas is prevented from occurring in the coupling portion between the plurality of first exhaust pipes and the first catalyst device and the coupling portion between the first catalyst device and the plurality of second exhaust pipes. This allows the catalyst to be activated quickly while preventing a reduction in the output performance of the engine due to the pressure interference.

The exhaust system may further include a third assembler that assembles second ends of the plurality of second exhaust pipes and a second detector provided at the third assembler and arranged to detect the information about the oxygen concentration of the gas exhausted from the plurality of cylinders, the controller may control the amounts of injected fuel in the plurality of cylinders based on the information about the oxygen concentration detected by the first detector and the information about the oxygen concentration detected by the second detector.

This enables the second detector to measure the information about the oxygen concentrations of the gases exhausted from all of the cylinders. Accordingly, since the amounts of injected fuel in the respective cylinders can be controlled taking the information about the oxygen concentration in all of the cylinders into consideration, the purification efficiency of the first catalyst can be further reliably improved.

The exhaust system may further include a second catalyst device connected to the third assembler and having a second catalyst that cleanses the gases introduced through the plurality of second exhaust pipes.

In this case, the gases introduced through the plurality of second exhaust pipes are cleansed in the second catalyst device. Thus, harmful substances contained in the exhaust gas can be reliably removed. In addition, the amounts of injected fuel in the plurality of cylinders are controlled such that the air-fuel ratio calculated based on the result of detection by the second detector is equal to the target air-fuel ratio, thereby making it possible to further improve the purification efficiency of the second catalyst device.

The first assembler may preferably have a substantially cylindrical body and a partition that divides the inside of the substantially cylindrical body into the plurality of first inflow portions corresponding in number to the plurality of first exhaust pipes, and the second assembler may have a substantially cylindrical body and a partition that divides the inside of the substantially cylindrical body into the plurality of second inflow portions corresponding in number to the plurality of second exhaust pipes.

In this case, the plurality of first and second inflow portions can be easily formed without making the structures of the first and second assemblers complex.

An area of each first inflow portion may be equal to an area of each second inflow portion opposed to the first inflow portion.

In this case, the gas introduced through each of the first exhaust pipes can be surely brought to each of the corresponding second exhaust pipes. This can surely prevent the gases introduced through the plurality of first exhaust pipes from interfering with one another in the second assembler.

An engine device according to another preferred embodiment of the present invention includes an engine having a plurality of cylinders, and an exhaust system that exhausts gas from the plurality of cylinders of the engine, the exhaust system including a same number of first exhaust pipes as the plurality of cylinders, into which the gas exhausted from the plurality of cylinders flows, respectively, a first catalyst device having a first catalyst that cleanses the gas introduced through the plurality of first exhaust pipes, a first assembler that assembles first ends of the plurality of first exhaust pipes and couples the first ends to the first catalyst device, a plurality of first inflow portions provided at the first assembler that cause the gas flowing out of the plurality of first exhaust pipes to flow into the first catalyst device, a first detector provided in any one of the plurality of first exhaust pipes or any one of the plurality of first inflow portions and arranged to detect the information about oxygen concentration of the gas exhausted from a respective one of the plurality of cylinders, and a controller that controls the amounts of injected fuel in the plurality of cylinders based on the information about the oxygen concentration of the gas detected by the first detector, wherein the first assembler is connected to the first catalyst device such that the plurality of first inflow portions are not in communication with each other.

In the engine device, the above-described exhaust system is adapted to the engine having the plurality of cylinders. Accordingly, the gases exhausted from the plurality of cylinders of the engine flow into the plurality of first exhaust pipes, respectively. The gas flowing into the plurality of first exhaust pipes flows into the first catalyst device through the plurality of first inflow portions of the first assembler, respectively, and is cleansed by the first catalyst.

The first detector that is provided in any one of the plurality of first exhaust pipes or any one of the plurality of first inflow portions detects the information about the oxygen concentration of the gas. The controller controls the amounts of injected fuel in the plurality of cylinders based on the information about the oxygen concentration detected by the first detector.

In this case, it is possible to control the amounts of injected fuel in all of the cylinders based on the information about the oxygen concentration detected by the first detector that is provided in any one of the plurality of first exhaust pipes or any one of the plurality of first inflow portions such that the first catalyst can efficiently achieve its cleansing performance.

In this way, since the need to detect the information about the oxygen concentration in each cylinder is eliminated and the amounts of injected fuel in all of the cylinders can be determined based on the information about the oxygen concentration in any of the cylinders, it is not necessary to provide a plurality of first detectors. This enables the purification efficiency of the first catalyst to be improved at low cost.

Furthermore, the first assembler is connected to the first catalyst device such that the plurality of first inflow portions are not in communication with each other. In this case, the gases introduced through the plurality of first exhaust pipes are prevented from interfering with one another in the first assembler when the gases flow into the first catalyst device from the first inflow portions. Accordingly, even if the first catalyst device is arranged close to the engine in order to cause the high temperature gas to flow into the first catalyst, a reduction in the output performance of the engine due to pressure interference of the gas can be prevented.

A vehicle according to a further preferred embodiment of the present invention includes an engine having a plurality of cylinders, a drive wheel, a transmission mechanism that transmits power generated by the engine to the drive wheel, and an exhaust system that exhausts gas from the plurality of cylinders of the engine, the exhaust system including a same number of first exhaust pipes as the plurality of cylinders, into which the gas exhausted from the plurality of cylinders flows, respectively, a first catalyst device having a first catalyst that cleanses the gas introduced through the plurality of first exhaust pipes, a first assembler that assembles first ends of the plurality of first exhaust pipes and couples the first ends to the first catalyst device, a plurality of first inflow portions provided at the first assembler that allow the gas exhausted from the plurality of first exhaust pipes to flow into the first catalyst device, a first detector provided in any one of the plurality of first exhaust pipes or any one of the plurality of first inflow portions that detects the information about oxygen concentration of the gas exhausted from a respective one of the plurality of cylinders and a controller that controls the amount of injected fuel in the plurality of cylinders, based on the information about the oxygen concentration detected by the first detector, wherein the first assembler is connected to the first catalyst device such that the plurality of first inflow portions are not in communication with each other.

In the vehicle, the power generated by the engine is transmitted to the drive wheel by the transmission mechanism so as to drive the drive wheel. Furthermore, the above-described exhaust system is adapted to the engine. Accordingly, the gas exhausted from the plurality of cylinders of the engine flows into the plurality of first exhaust pipes, respectively. The gas flowing into the plurality of first exhaust pipes flows into the first catalyst device through the plurality of first inflow portions of the first assembler, respectively, and is cleansed by the first catalyst.

The first detector that is provided in any one of the plurality of first exhaust pipes or any one of the plurality of first inflow portions detects the information about the oxygen concentration of the gas. The controller controls the amounts of injected fuel in the plurality of cylinders based on the information about the oxygen concentration detected by the first detector.

In this case, it is possible to control the amounts of injected fuel in all of the cylinders based on the information about the oxygen concentration detected by the first detector that is provided in any one of the plurality of first exhaust pipes or any one of the plurality of first inflow portions such that the first catalyst can efficiently achieve its cleansing performance.

In this way, since the need to detect the information about the oxygen concentration in each cylinder is eliminated and the amounts of injected fuel in all of the cylinders can be determined based on the information about the oxygen concentration in any of the cylinders, it is not necessary to provide a plurality of first detectors. This enables the purification efficiency of the first catalyst to be improved at low cost.

Furthermore, the first assembler is connected to the first catalyst device such that the plurality of first inflow portions are not in communication with each other. In this case, the gases introduced through the plurality of first exhaust pipes are prevented from interfering with one another in the first assembler when the gases flow into the first catalyst device from the first inflow portions. Accordingly, even if the first catalyst device is arranged close to the engine in order to cause the high temperature gas to flow into the first catalyst, a reduction in the output performance of the engine due to pressure interference of the gas can be prevented.

Other features, elements, characteristics, and advantages of the present invention will become more apparent from the following description of preferred embodiments of the present invention with reference to the attached drawings.

DETAILED DESCRIPTION OF PREFERRED EMBODIMENTS

Hereinafter, an exhaust system according to preferred embodiments of the present invention, and an engine device and a vehicle including the same are described. In the present preferred embodiment, a motorcycle with an inline four cylinder engine is described as an example but it is in no way limiting of the present invention.

(1) Configuration of the Motorcycle

Figure 1:
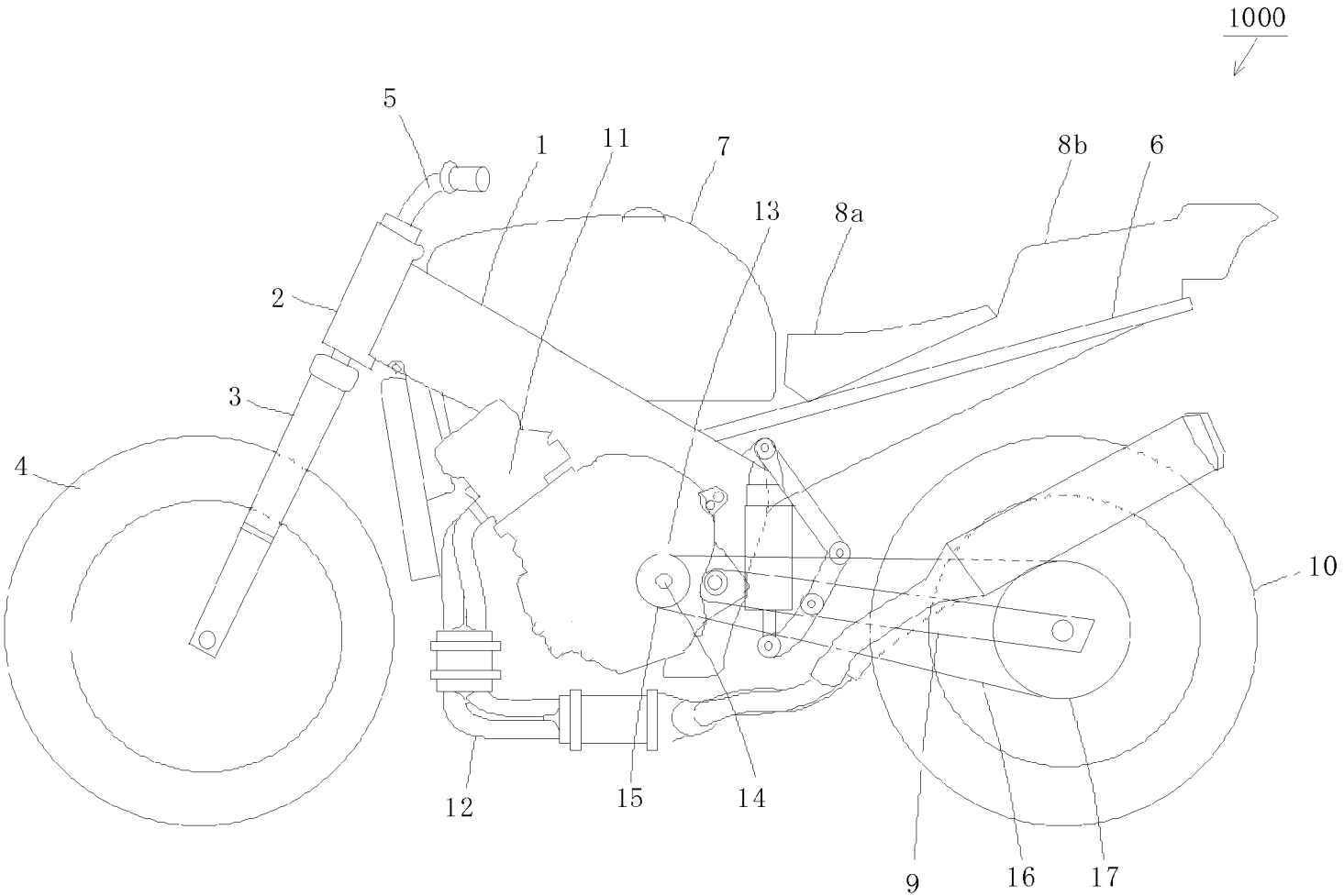
FIG. 1 is a schematic view of a motorcycle according to a preferred embodiment of the present invention.

FIG. 1 is a schematic view of a motorcycle according to a preferred embodiment of the present invention.

In the motorcycle 1000 of FIG. 1, a body frame 1 is provided with a head pipe 2 at its front end. The head pipe 2 is provided with a front fork 3 that can swing left and right. At the lower end of the front fork 3 is a front wheel 4 that is rotatably supported thereon. A handle 5 is mounted at the upper end of the head pipe 2.

A seat rail 6 is mounted to extend rearwardly from an upper portion of the back end of the body frame 1. A fuel tank 7 is provided above the body frame 1. A main seat 8*a* and a tandem seat 8*b* are provided on the seat rail 6.

A rear arm 9 is mounted to extend rearwardly from the rear end of the body frame 1. A rear wheel 10 is rotatably supported at the rear end of the rear arm 9.

An engine 11 is mounted preferably in the approximate center of the body frame 1. An exhaust device 12 is mounted to exhaust ports of the engine 11.

The engine 11 is coupled to a transmission 13. A drive sprocket 15 is mounted around a drive shaft 14 of the transmission 13. The drive sprocket 15 is coupled via a chain 16 to a rear wheel sprocket 17 of the rear wheel 10.

(2) Configuration of the Exhaust Device

Figure 2:
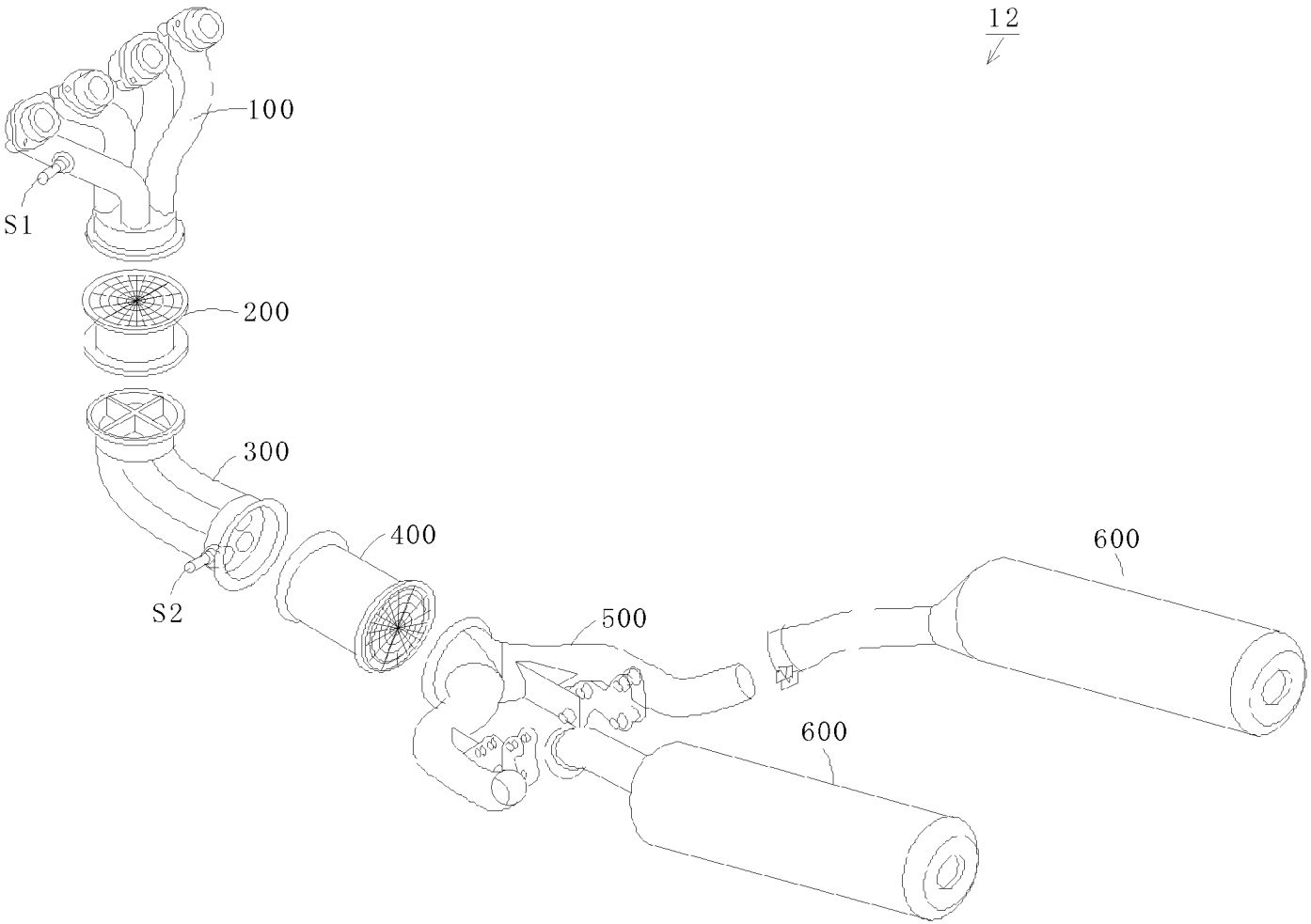
FIG. 2 is an exploded perspective view showing a configuration of an exhaust device of FIG. 1.

FIG. 2 is an exploded perspective view showing a configuration of the exhaust device 12 of FIG. 1.

As shown in FIG. 2, the exhaust device 12 according to the present preferred embodiment includes a first exhaust pipe group 100, a first catalyst device 200, a second exhaust pipe group 300, a second catalyst device 400, a branch pipe 500, and muffler devices 600.

Exhaust gas exhausted from the exhaust ports of respective cylinders of the engine 11 (refer to FIG. 1) flows into the muffler devices 600 through the first exhaust pipe group 100, the first catalyst device 200, the second exhaust pipe group 300, the second catalyst device 400, and the branch pipe 500 and, after sound muffling is performed in the muffler devices 600, the exhaust gas is exhausted to the outside. Hereinafter, a further detailed description of the first exhaust pipe group 100, the first catalyst device 200, and the second exhaust pipe group 300 is provided.

Figure 3:
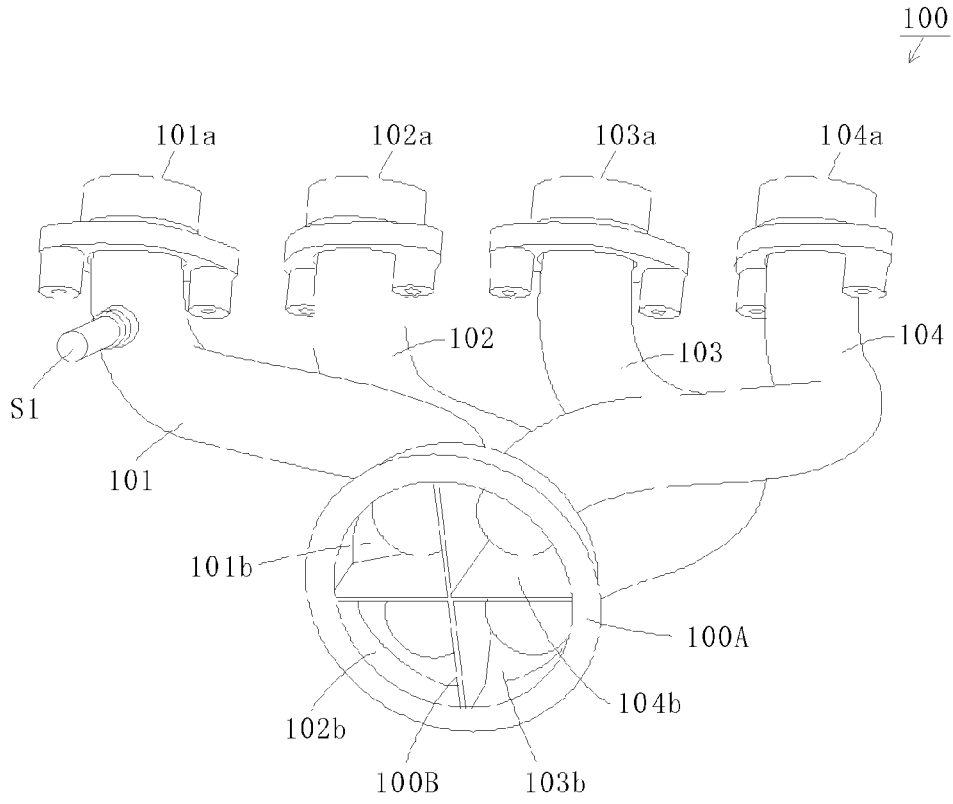
FIG. 3 is a perspective view showing a first exhaust pipe group.

FIG. 3 is a perspective view showing the first exhaust pipe group 100. As shown in FIG. 3, the first exhaust pipe group 100 preferably includes exhaust pipes 101, 102, 103, 104. Coupling portions 101*a*, 102*a*, 103*a*, 104*a* are provided at first ends of the exhaust pipes 101, 102, 103, 104, respectively. The respective coupling portions 101*a*, 102*a*, 103*a*, 104*a* are attached to the exhaust ports of the respective cylinders of the engine 11 (refer to FIG. 1).

A coupling pipe 100A is provided at the second end portions of the exhaust pipes 101, 102, 103, 104. In the coupling pipe 100A, four spaces 101*b*, 102*b*, 103*b*, 104*b* are preferably formed by a cross-shaped partition plate 100B.

Internal spaces of the respective exhaust pipes 101, 102, 103, 104 communicate with the spaces 101*b*, 102*b*, 103*b*, 104*b* of the coupling pipe 100A, respectively. Since the spaces 101*b*, 102*b*, 103*b*, 104*b* are not in communication with each other, the exhaust gases from the engine 11 do not interfere with one another in the coupling pipe 100A.

A first oxygen sensor S1 is attached to any one of the plurality of exhaust pipes 101 to 104 of the first exhaust pipe group 100 or to the portion that is a side wall of any one of the spaces 101*b* to 104*b* in the coupling pipe 100A. In the example of FIG. 3, the first oxygen sensor S1 is attached to the exhaust pipe 101. A linear output type universal exhaust gas oxygen (UEGO) sensor is preferably used as the first oxygen sensor S1. This makes it possible to accurately detect the air-fuel ratio.

Figure 4A:
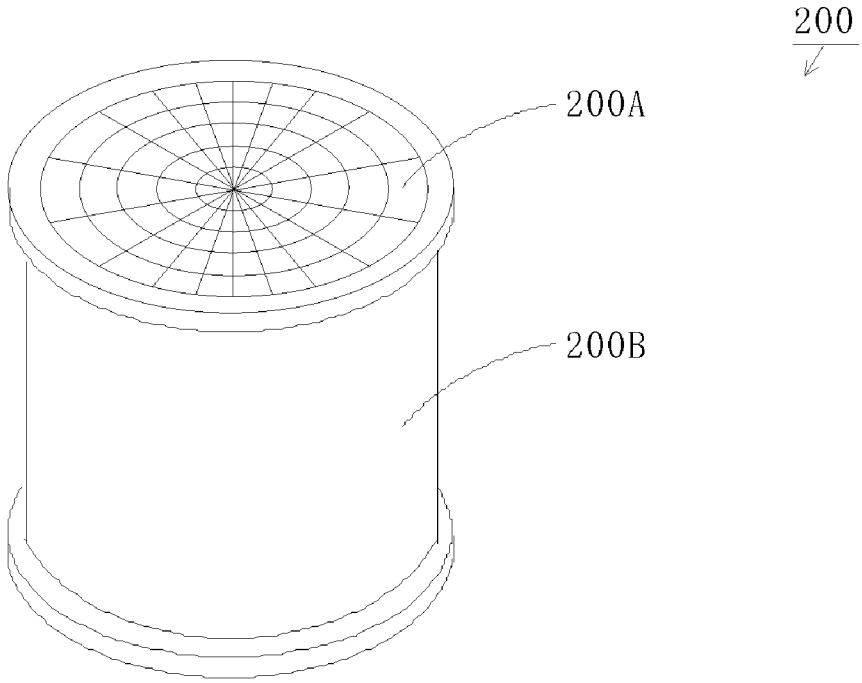
FIGS. 4A and 4B are views showing a first catalyst device.

FIG. 4A is a perspective view showing the first catalyst device 200. As shown in FIG. 4A, in the first catalyst device 200, a columnar catalyst 200A is contained in a cylindrical catalyst container 200B. In the present preferred embodiment, as the catalyst 200A, a three-way catalyst obtained by applying catalytic metals such as platinum (Pt), palladium (Pd), and rhodium (Rh) to a substrate, for example, is preferably used. This catalyst 200A converts HC, CO, and $NO_x$ contained in the exhaust gas of the engine 11 into $CO_2$, $H_2O$, and $N_2$.

Figure 4B:
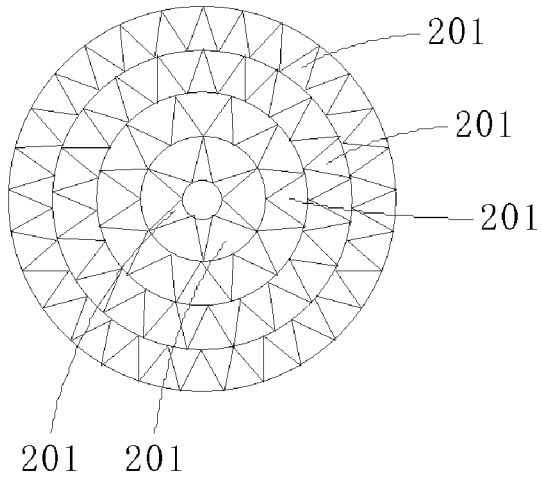

FIG. 4B is an enlarged schematic view of an upper surface portion of the catalyst 200A shown in FIG. 4A. Over an entire surface of the catalyst 200A, there are provided a plurality of flow paths 201 each extending in an axial direction with a substantially triangular cross section as shown in FIG. 4B. Since the respective flow paths 201 are not in communication with each other, the exhaust gases flowing into the respective flow paths 201 from the first exhaust pipe group 100 (refer to FIG. 1) do not interfere with one another in the first catalyst device 200.

The second catalyst device 400 (refer to FIG. 2) also has a construction similar to the first catalyst device 200. Furthermore, the shape of the cross-section of the flow paths 201 of the catalyst 200A is not limited to triangular, but may be other shapes such as quadrangular or hexagonal, or any other suitable shape.

Figure 5:
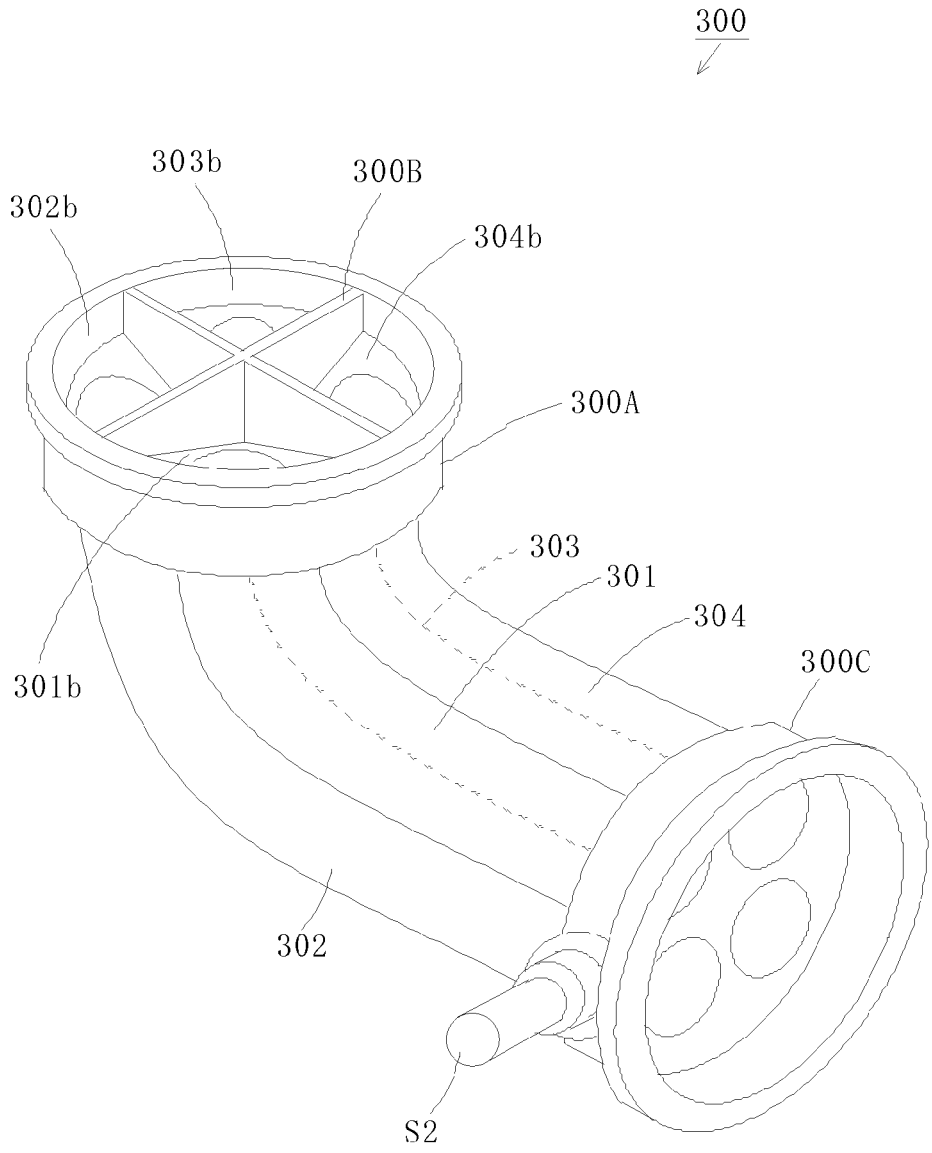
FIG. 5 is a perspective view showing a second exhaust pipe group.

FIG. 5 is a perspective view showing the second exhaust pipe group 300. As shown in FIG. 5, the second exhaust pipe group 300 has exhaust pipes 301, 302, 303, 304. A coupling pipe 300A is provided at first ends of the exhaust pipes 301, 302, 303, 304. In the coupling pipe 300A, four spaces 301*b*, 302*b*, 303*b*, 304*b* are formed by a cross-shaped partition plate 300B.

Internal spaces of the respective exhaust pipes 301, 302, 303, 304 communicate with the spaces 301*b*, 302*b*, 303*b*, 304*b* of the coupling pipe 300A, respectively. Since the spaces 301*b*, 302*b*, 303*b*, 304*b* are not in communication with each other, the exhaust gases flowing from the first catalyst device 200 do not interfere with one another in the coupling pipe 300A.

A coupling pipe 300C is provided at the second end portions of the exhaust pipes 301, 302, 303, 304. The coupling pipe 300C has no partition plate, and the exhaust gases passing through the exhaust pipes 301, 302, 303, 304 flow into the coupling pipe 300C, respectively. A second oxygen sensor S2 is attached to the side wall of the coupling pipe 300C. Although a UEGO sensor may be used as the second oxygen sensor S2, similarly to the first oxygen sensor S1, a commonly used switching output type oxygen sensor is preferably used in terms of cost. The first oxygen sensor S1 and the second oxygen sensor S2 are not limited to the above-mentioned oxygen sensors, and any sensors capable of measuring oxygen concentration can be used.

Figure 6:
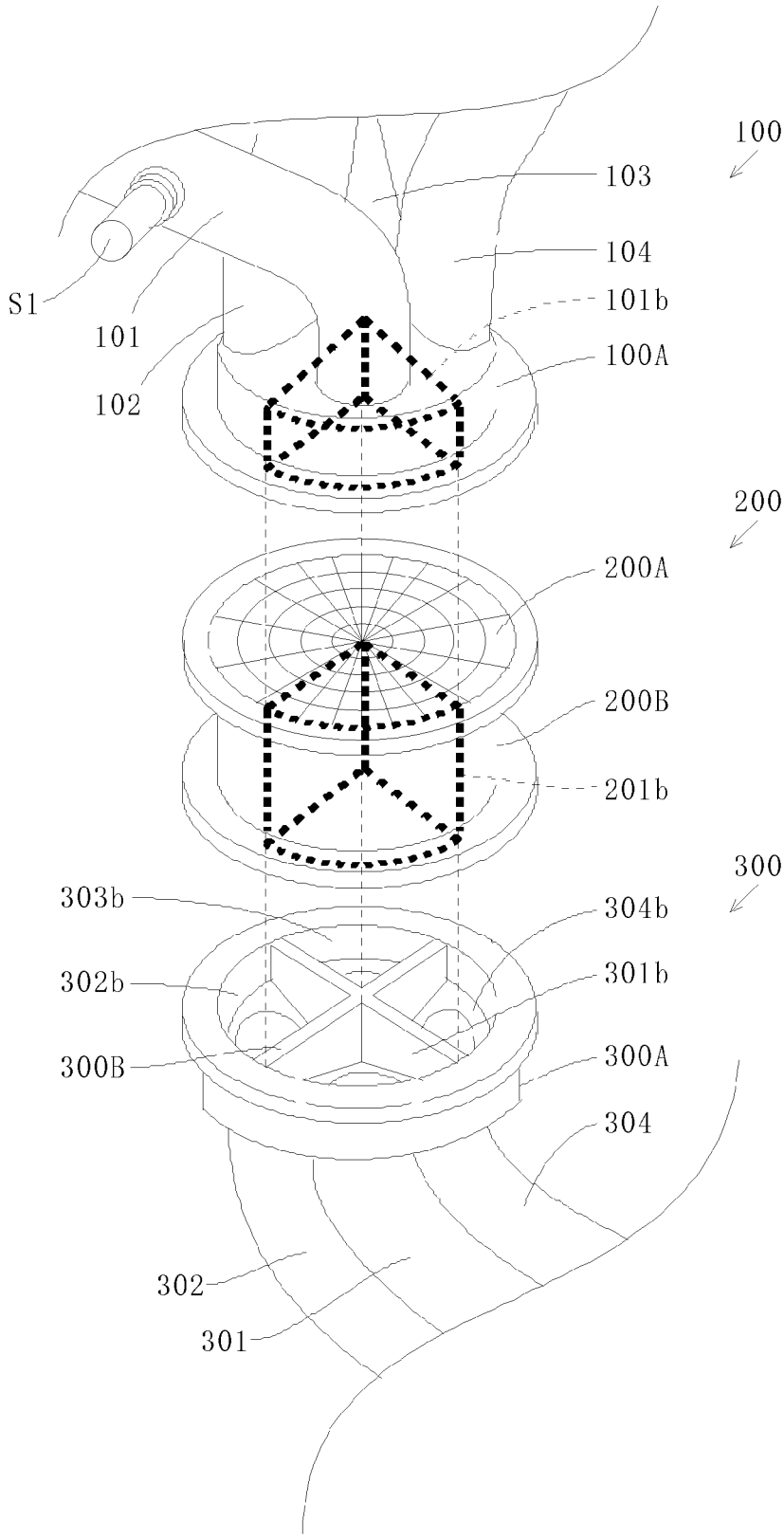
FIG. 6 is a perspective view showing a joining method of the first exhaust pipe group, the first catalyst device, and the second exhaust pipe group.

FIG. 6 is a perspective view showing a joining method of the first exhaust pipe group 100, the first catalyst device 200, and the second exhaust pipe group 300.

As shown in FIG. 6, the first exhaust pipe group 100 and the second exhaust pipe group 300 are joined such that the coupling pipe 100A and the coupling pipe 300A are connected to opposite ends of the catalyst container 200B. The joint between the coupling pipe 100A and the catalyst container 200B, and the joint between the catalyst container 200B and the coupling pipe 300A, may be formed by welding, or by forming flanges on ends of the coupling pipe 100A, the catalyst container 200B, and the coupling pipe 300A, respectively, and joining the flanges with bolts and nuts.

In the first exhaust pipe group 100, the end surface of the coupling pipe 100A (refer to FIG. 3) and an end surface of the partition plate 100B (refer to FIG. 3) are flush with each other. Furthermore, in the second exhaust pipe group 300, the end surface of the coupling pipe 300A (refer to FIG. 5) and an end surface of the partition plate 300B (refer to FIG. 5) are flush with each other. Furthermore, in the first catalyst device 200, an end surface of the catalyst 200A (refer to FIG. 4) and the end surface of the catalyst container 200B (refer to FIG. 4) are flush with each other. Accordingly, when the first exhaust pipe group 100, the first catalyst device 200, and the second exhaust pipe group 300 are joined, there is no clearance between the partition plate 100B and the catalyst 200A, and between the catalyst 200A and the partition plate 300B.

Furthermore, areas of the spaces 101*b*, 102*b*, 103*b*, 104*b* in contact with the catalyst 200A are equal to the areas of the spaces 301*b*, 302*b*, 303*b*, 304*b* in contact with the catalyst 200A, respectively.

Moreover, the coupling pipe 100A and the coupling pipe 300A are joined to the first catalyst device 200 such that the spaces 101*b*, 102*b*, 103*b*, 104*b* are opposed to the spaces 301*b*, 302*b*, 303*b*, 304*b*, respectively.

In this case, the exhaust gas flowing into the space 101*b* through the exhaust pipe 101 flows into the space 301*b* and the exhaust pipe 301 through a region 201*b* of the catalyst 200A, which is interposed between the space 101*b* and the space 301*b*(refer to FIG. 6).

Similarly, the exhaust gas flowing into the space 102*b* (refer to FIG. 3) flows into the space 302*b* and the exhaust pipe 302 through a region (not identified) of the catalyst 200A, which is interposed between the space 102*b* and the space 302*b*; the exhaust gas flowing into the space 103*b* (refer to FIG. 3) flows into the space 303*b* through a region (not identified) of the catalyst 200A, which is interposed between the space 103*b* and the space 303*b*; and the exhaust gas flowing into the space 104*b* (refer to FIG. 3) flows into the space 304*b* through a region (not identified) of the catalyst 200A, which is interposed between the space 104*b* and the space 304*b*.

Furthermore, as described above, since the plurality of flow paths 201 of the catalyst 200A (refer to FIG. 4B) are not in communication with each other, the exhaust gas flowing into one of respective flow paths 201 does not interfere with the exhaust gas flowing into another flow path 201.

Accordingly, the exhaust gases exhausted from the respective exhaust ports of the plurality of cylinders of the engine 11 (refer to FIG. 1) flow into the coupling pipe 300C of the second exhaust pipe group 300 (refer to FIGS. 2 and 5) without interfering with one another. It is not until the exhaust gas reaches this coupling pipe 300C that exhaust gas pressure interference occurs.

(3) Effects of the Exhaust Device

As described above, in the present preferred embodiment, no exhaust gas pressure interference occurs in the coupling portion between the first exhaust pipe group 100 and the first catalyst device 200, and the coupling portion between the first catalyst device 200 and the second exhaust pipe group 300. As a result, even if the first catalyst device 200 is arranged close to the engine 11 in order to cause the high temperature exhaust gas to flow into the catalyst 200A, a reduction in the output performance of the engine 11 due to exhaust gas pressure interference can be prevented.

Furthermore, since a catalyst does not need to be provided for each of the exhaust pipes 101, 102, 103, 104 of the first exhaust pipe group 100, the cost can be reduced.

Furthermore, a surface area of the catalyst 200A in the present preferred embodiment is smaller than a total surface area of the plural catalysts in the case where a catalyst is provided for each of the exhaust pipes 101, 102, 103, 104. In this case, the heat quantity radiating from the surface of the catalyst 200A can be reduced. More specifically, according to the present preferred embodiment, the heat quantity of the exhaust gas can be held in the first catalyst device 200 more efficiently as compared with the case where a catalyst is provided for each of the exhaust pipes 101, 102, 103, 104. This can easily raise the temperature of the catalyst 200A. As a result, the catalyst 200A can be quickly activated.

Furthermore, the second catalyst device 400 is preferably provided between the second exhaust pipe group 300 and the branch pipe 500. This can more reliably remove harmful substances of the exhaust gas.

It is preferable that components of the catalyst metals used in the first catalyst device 200 and the second catalyst device 400 and component ratios thereof are changed as necessary according to the structure of the exhaust device 12.

(4) Control of the Amount of Injected Fuel of the Engine

In the present preferred embodiment, the amount of injected fuel of the engine 11 is controlled based on the results of detection by the first oxygen sensor S1 and the second oxygen sensor S2. Hereinafter, the method of controlling is described.

(a) Preparation of Target Air-Fuel Ratio Maps

As mentioned above, the purification efficiency of the catalyst is significantly influenced by the air-fuel ratio of the engine. Therefore, in the present preferred embodiment, the air-fuel ratio of the engine 11 (herein after, referred to as the target air-fuel ratio) is determined such that the catalyst 200A of the first catalyst device 200 (refer to FIG. 4) can efficiently achieve its cleansing performance, and target air-fuel ratio maps are prepared based on the determined target air-fuel ratio.

Figure 7:
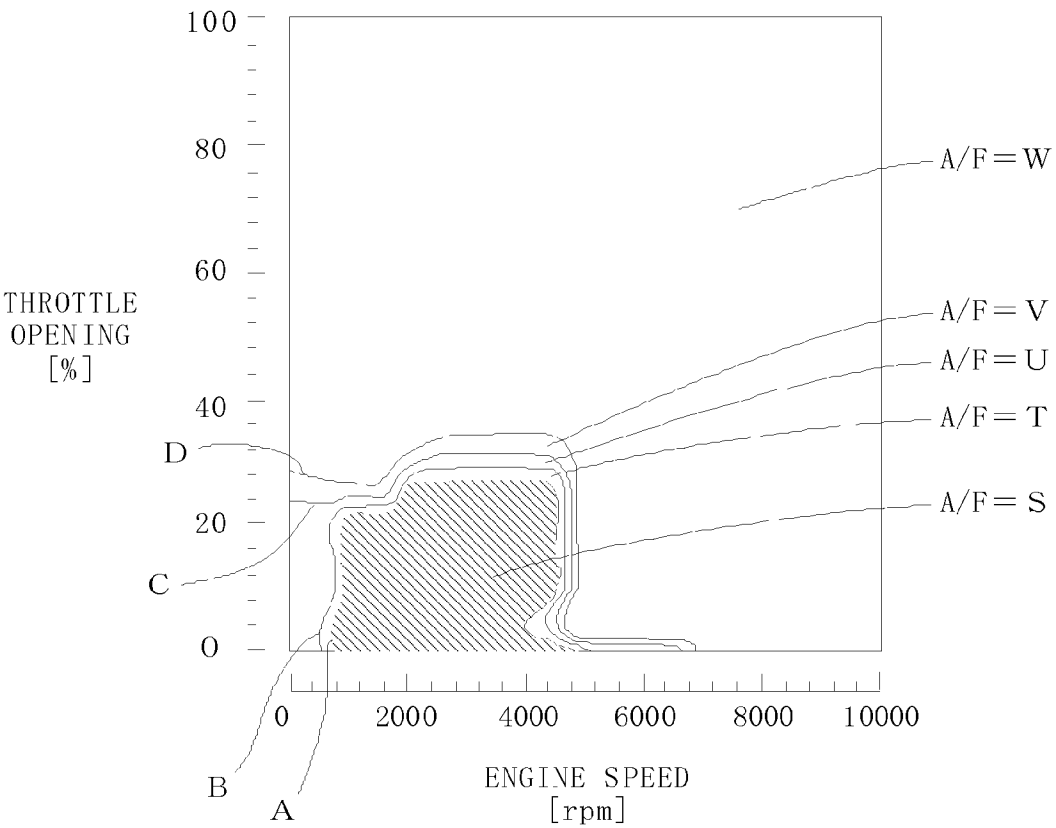
FIG. 7 is a graph showing an A/F throttle map.
Figure 8:
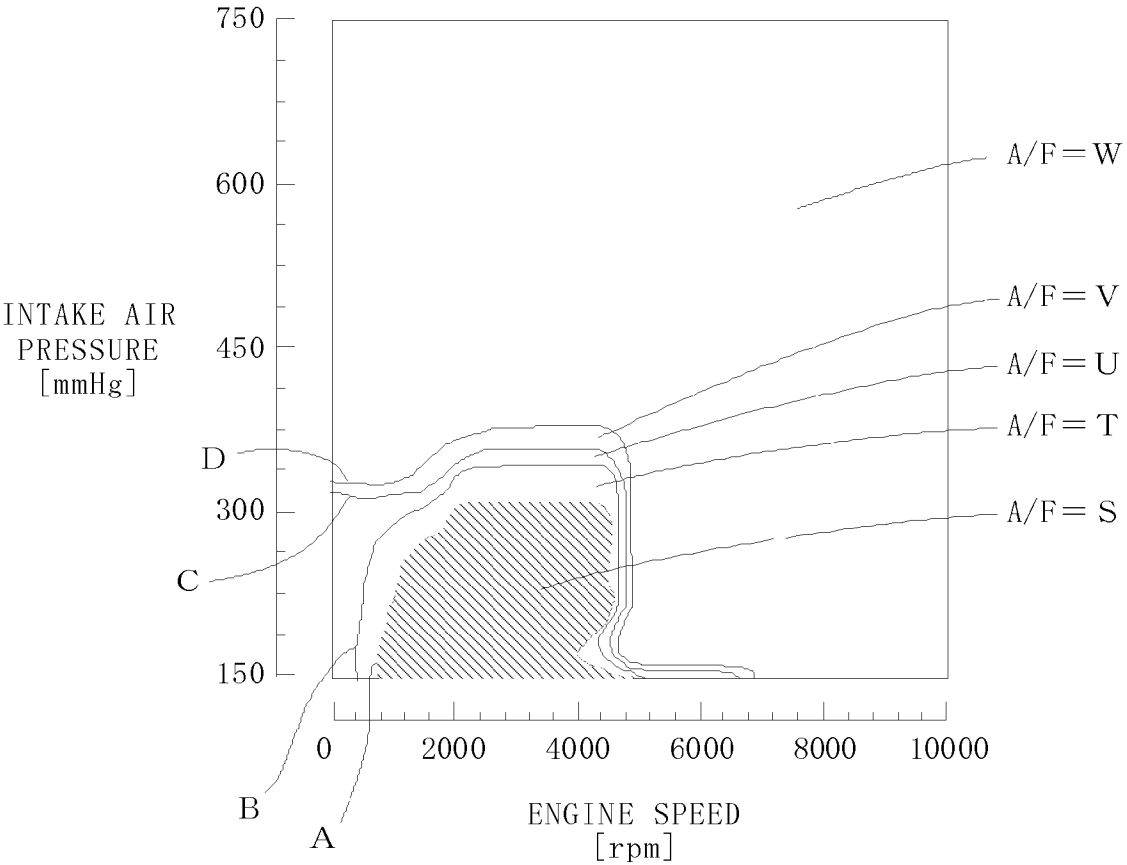
FIG. 8 is a graph showing an A/F boost map.

As the target air-fuel ratio maps, for example, a target air-fuel ratio map based on throttle opening and speed of the engine 11 as shown in FIG. 7 (herein after, referred to as an A/F throttle map) and a target air-fuel ratio map based on intake air pressure (boost) and the speed of the engine 11 as shown in FIG. 8 (herein after, referred to as an A/F boost map) are prepared. In FIG. 7, the ordinate axis indicates the throttle opening and the abscissa axis indicates the speed of the engine 11. Furthermore, in FIG. 8, the ordinate axis indicates the intake air pressure (boost) and the abscissa axis indicates the speed of the engine 11.

In addition, the solid lines A to D in FIGS. 7 and 8 indicate the transition of the target air-fuel ratio. For example, in each of FIGS. 7 and 8, a target air-fuel ratio in a diagonally shaded region is S, and a target air-fuel ratio in a region surrounded by a solid line A and a solid line B outside the diagonally shaded region is T. Similarly, a target air-fuel ratio in an outer region surrounded by the solid line B and a solid line C is U, and a target air-fuel ratio in an outer region surrounded by the solid line C and a solid line D is V, and a target air-fuel ratio in the outermost region is W. In FIGS. 7 and 8, "A/F" indicates the air-fuel ratio and S to W indicate the values that are arbitrarily determined.

In the target air-fuel ratio maps, for example, the target air-fuel ratio in the region where the highest purification efficiency of the catalyst 200 A is desired (for example, during idling and at medium and low speeds) is set as a stoichiometric air-fuel ratio (14.5), and the target air-fuel ratios in the regions excluding that region are determined as necessary so as to be the air-fuel ratios with which ideal driving of the vehicle can be realized. In the examples of FIGS. 7 and 8, the relationship of S=14.5 is satisfied.

(b) Preparation of the Injected Fuel Amount Maps and Determination of a Standard Cylinder In the present preferred embodiment, a single standard cylinder is determined (herein after, referred to as a standard cylinder), and the first oxygen sensor S1 is attached to the exhaust pipe connected to the exhaust port of the standard cylinder (herein after, referred to as a standard exhaust pipe) among the plurality of exhaust pipes 101 to 104 in the first exhaust pipe group 100. Hereinafter, the method of determining the standard cylinder is described.

First of all, based on the two aforementioned target air-fuel ratio maps, injected fuel amount maps of the respective cylinders of the engine 11 are prepared according to experiments. As the injected fuel amount maps, there are two types of maps prepared, one of which is an injected fuel amount map determined by the throttle opening of each cylinder and the speed of the engine 11 (herein after, referred to as an IN throttle map) as shown in FIGS. 9A to 9D, and another of which is an injected fuel amount map determined by the intake air pressure (boost) in each cylinder and the speed of the engine 11 (herein after, referred to as an IN boost map) as shown in FIGS. 10A to 10D.

Figure 9B:
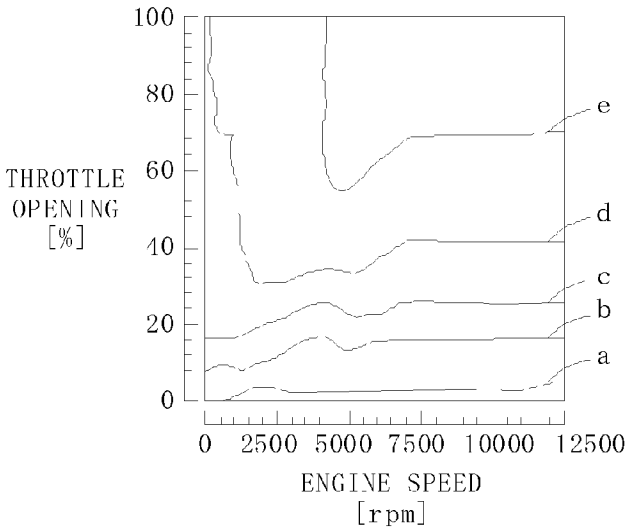
FIGS. 9A, 9B, 9C, and 9D are graphs showing IN throttle maps.
Figure 9A:
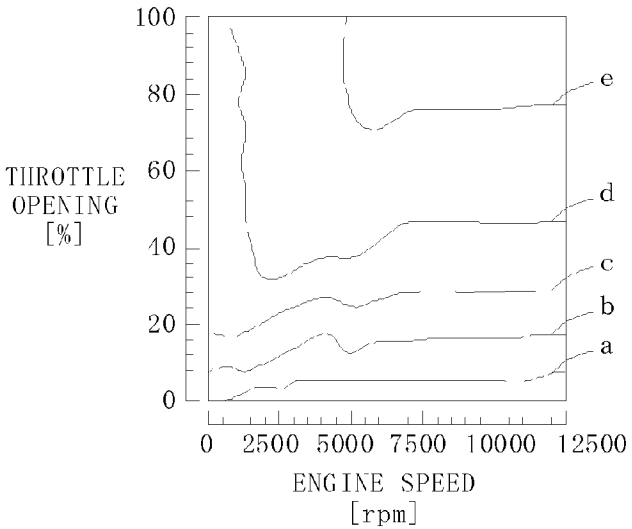
Figure 9D:
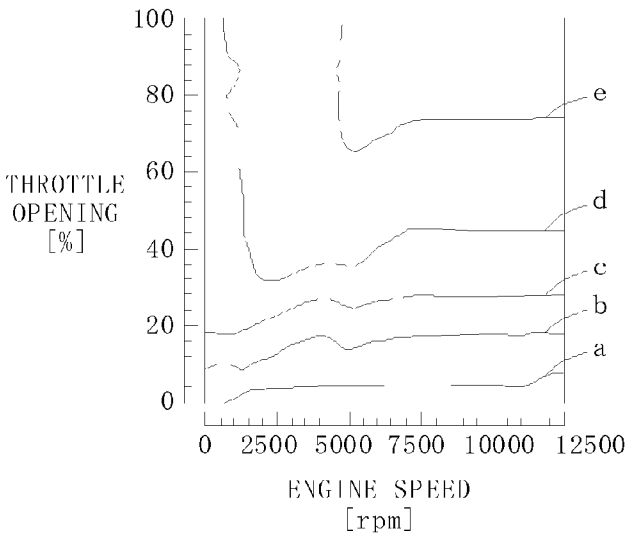
Figure 9C:
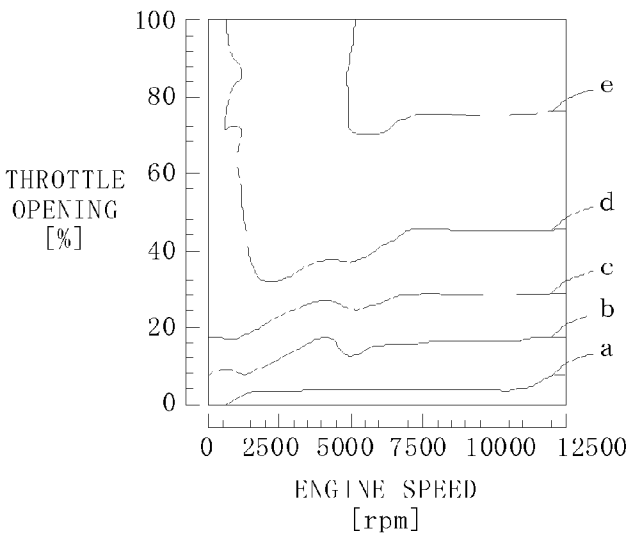
Figure 10A:
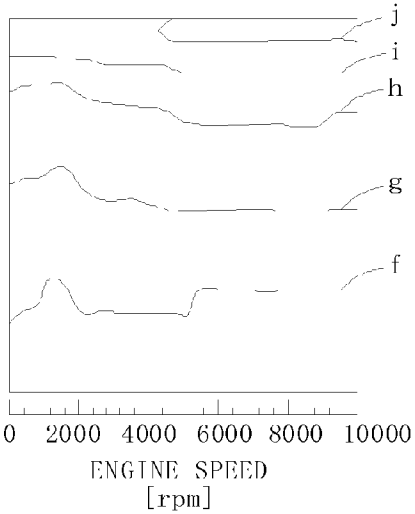
FIGS. 10A, 10B, 10C, and 10D are graphs showing IN boost maps.
Figure 10B:
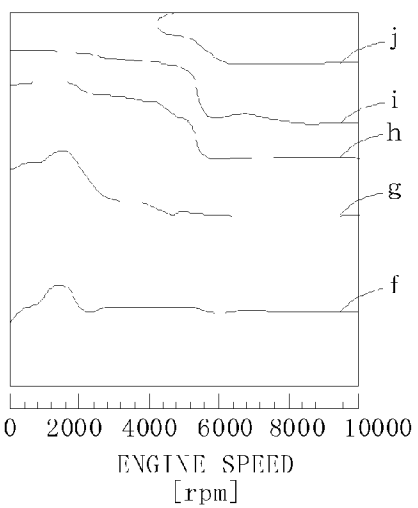
Figure 10C:
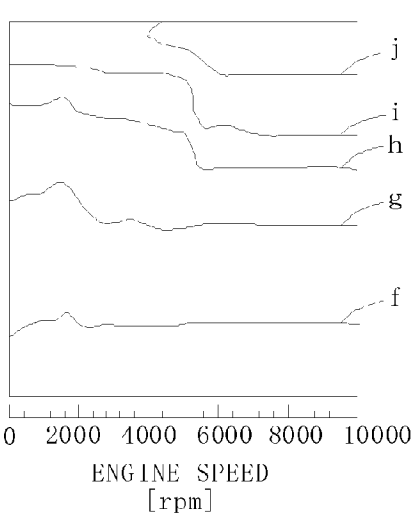
Figure 10D:
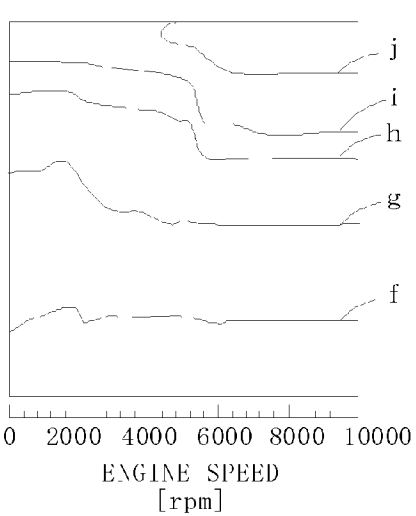

FIGS. 9A and 10A show the injected fuel amount map of a first cylinder, FIGS. 9B and 10B show the injected fuel amount map of a second cylinder, FIGS. 9C and 10C show the injected fuel amount map of a third cylinder, and FIGS. 9D and 10D show the injected fuel amount map of a fourth cylinder. Furthermore, in FIGS. 9A to 9D, the ordinate axis indicates the throttle opening, and the abscissa axis indicates the speed of the engine 11. In FIGS. 10A to 10D, the ordinate axis indicates the intake air pressure (boost), and the abscissa axis indicates the speed of the engine 11.

The solid lines a to e in FIGS. 9A to 9D and the solid lines f to j in FIGS. 10A to 10D indicate the isolines of the amount of injected fuel. The amounts of injected fuel indicated by the solid lines a to e satisfy the relation of a<b<c<d<e, and the amount of injected fuel indicated by the solid lines f to j satisfy the relation of f<g<h<i<j. More specifically, in FIGS. 9A to 9D, the amount of injected fuel increases from the region adjacent to the solid line a toward the region adjacent to the solid line e, and in FIGS. 10A to 10D, the amount of injected fuel increases from the region adjacent to the solid line f toward the region adjacent to the solid line j.

Figure 11:
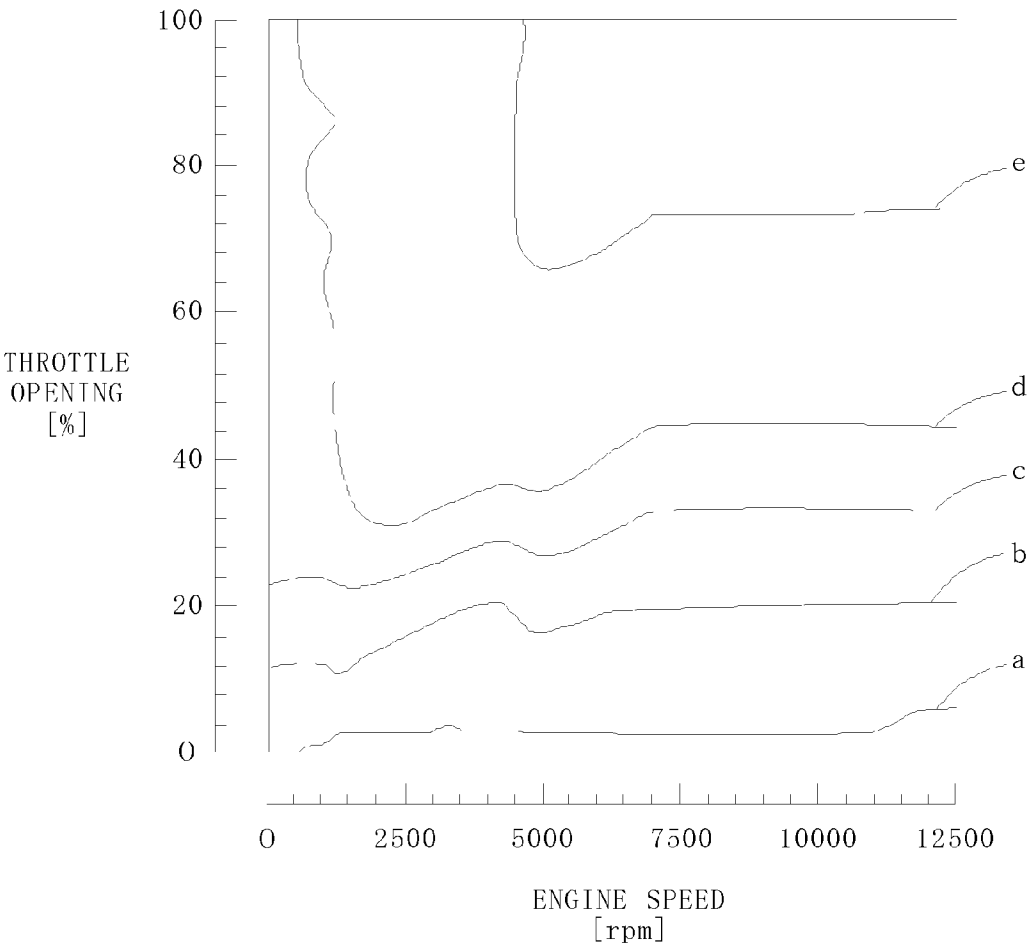
FIG. 11 is a graph showing an average throttle map.
Figure 12:
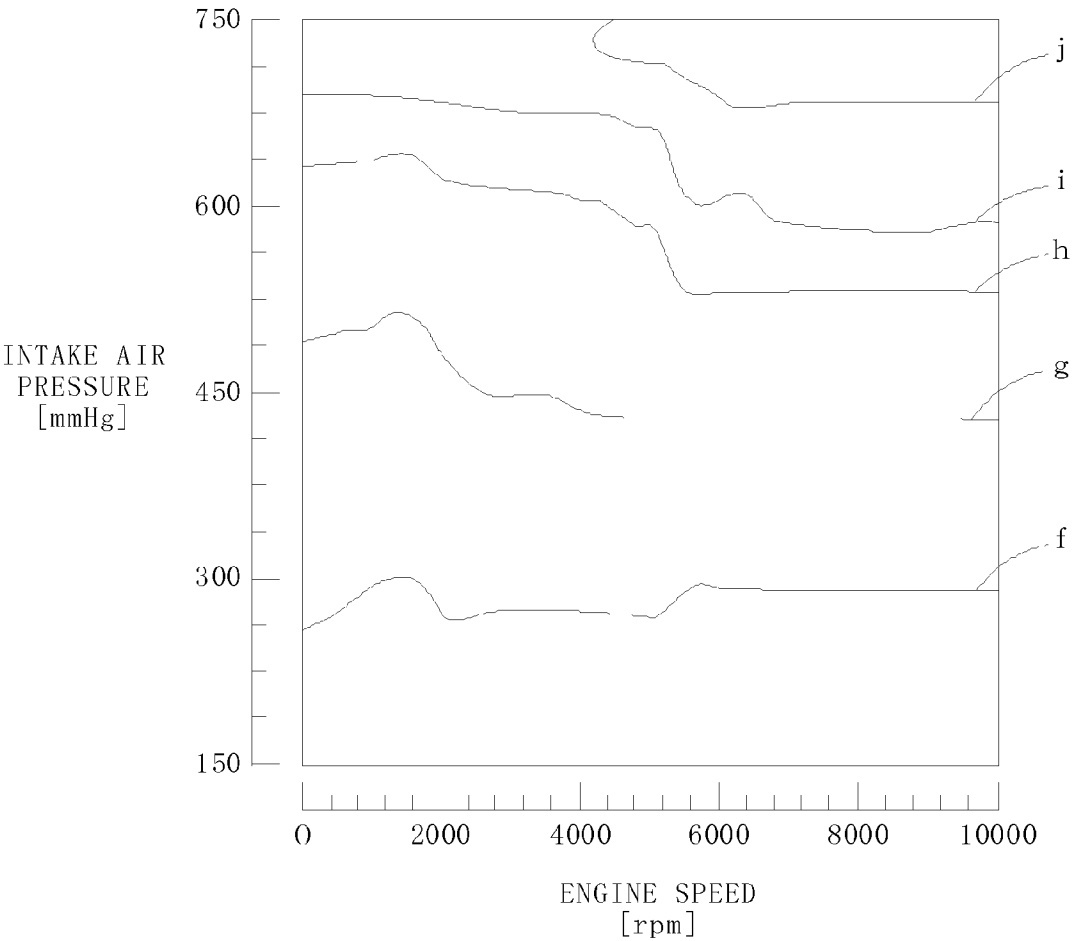
FIG. 12 is a graph showing an average boost map.
Figure 13A:
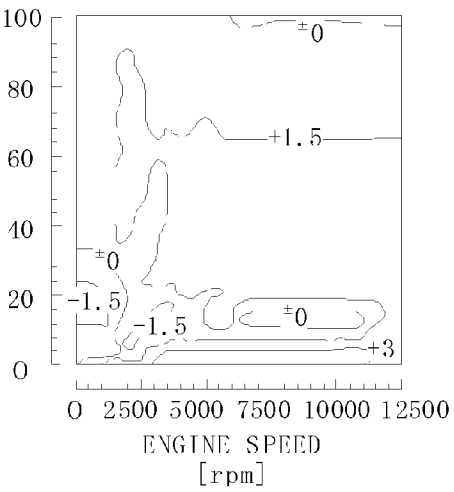
FIGS. 13A, 13B, 13C, and 13D are graphs showing deviation throttle maps.
Figure 13B:
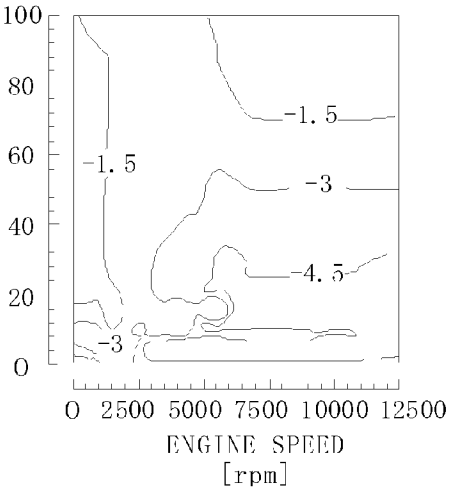
Figure 13C:
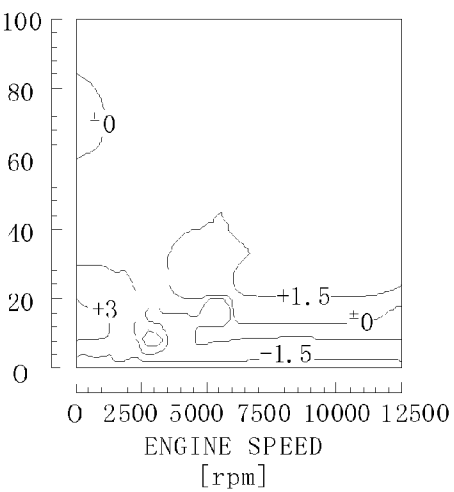
Figure 13D:
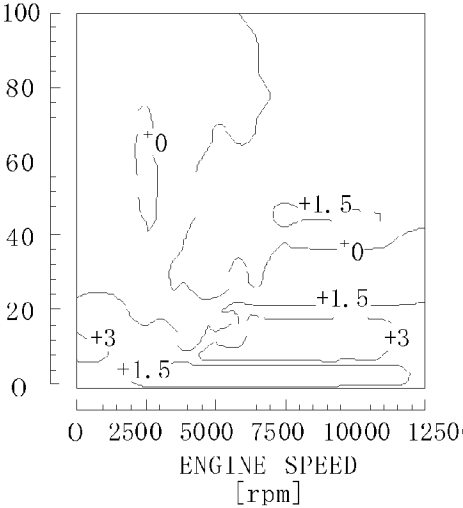
Figure 14A:
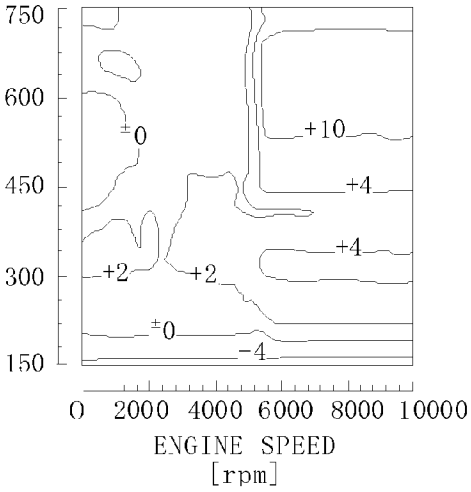
FIGS. 14A, 14B, 14C, and 14D are graphs showing deviation boost maps.
Figure 14B:
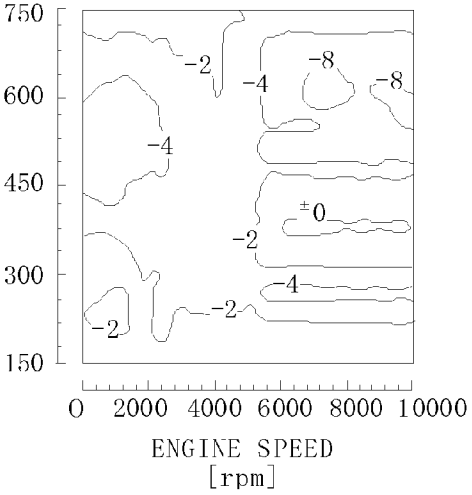
Figure 14C:
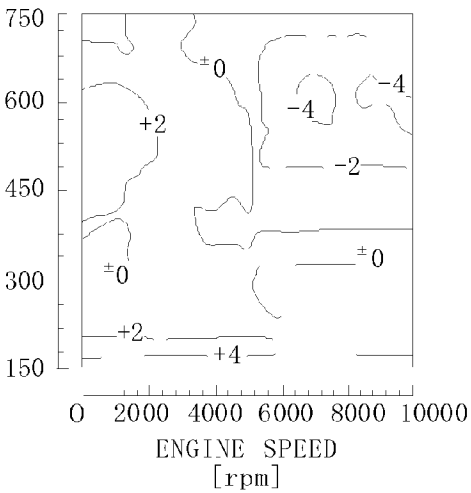
Figure 14D:
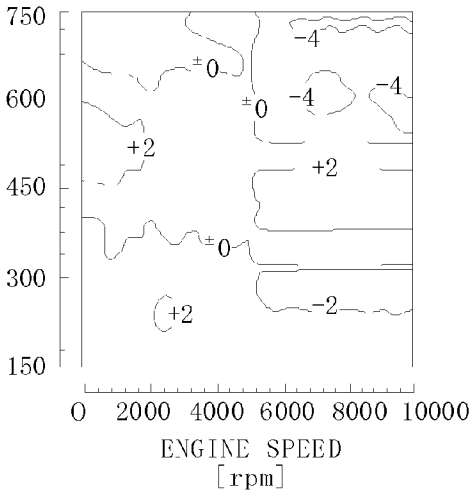

Next, as shown in FIG. 11, the average of the amounts of injected fuel in the four cylinders is calculated based on the amounts of injected fuel in the respective cylinders obtained from the IN throttle maps (refer to FIGS. 9A to 9D), and the injected fuel amount map showing the calculated average (herein after, referred to as an average throttle map) is prepared. Similarly, as shown in FIG. 12, the average of the amounts of injected fuel in the four cylinders is calculated based on the amounts of injected fuel in the respective cylinders obtained from the IN boost map (refer to FIGS. 10A to 10D), and the injected fuel amount map showing the calculated average (herein after, referred to as an average boost map) is prepared.

In FIG. 11, the ordinate axis indicates the throttle opening and the abscissa axis indicates the speed of the engine 11. Furthermore, in FIG. 12, the ordinate axis indicates the intake air pressure (boost) and the abscissa axis indicates the speed of the engine 11. In addition, in FIGS. 11 and 12, the solid lines a to e and f to j satisfy the relations explained in FIGS. 9A to 9D and 10A to 10D.

Then, the differences between the amounts of injected fuel obtained from the IN throttle maps (refer to FIGS. 9A to 9D) of the respective cylinders and the amount of injected fuel obtained from the average throttle map (refer to FIG. 11) are calculated, and based on the calculated values, as shown in FIGS. 13A to 13D, maps showing the deviations of the respective IN throttle maps to the average throttle map (herein after, referred to as a deviation throttle map) are prepared.

Similarly, the differences between the amounts of injected fuel obtained from the IN boost maps (refer to FIGS. 10A to 10D) of the respective cylinders and the amount of injected fuel obtained from the average boost map (refer to FIG. 12) are calculated, and based on the calculated values, as shown in FIG. 14, maps showing the deviations of the respective IN boost map to the average boost map (herein after, referred to as a deviation boost map) are prepared.

FIGS. 13A to 13D and FIGS. 14A to 14D show the deviation throttle maps and the deviation boost maps of the first cylinder, the second cylinder, the third cylinder, and the fourth cylinder, respectively. In addition, in FIGS. 13A to 13D, the ordinate axis indicates the throttle opening and the abscissa axis indicates the speed of the engine 11. In FIGS. 14A to 14D, the ordinate axis indicates the intake air pressure (boost) and the abscissa axis indicates the speed of the engine 11. Furthermore, in FIGS. 13A to 13D and FIGS. 14A to 14D, the solid lines are the contour lines of the deviation (%). The numeric values shown in FIGS. 13A to 13D and FIGS. 14A to 14D indicate the deviation (%).

Finally, comparing the deviation throttle maps of the respective cylinders and the deviation boost maps thereof, for example, the cylinder which has the smallest deviation in the regions showing the stoichiometric air-fuel ratio in the target air-fuel ratio maps (the diagonally shaded regions in FIGS. 7 and 8), is selected and the selected cylinder is regarded as the standard cylinder. In the example of FIG. 3, the exhaust pipe 101 is the standard exhaust pipe connected to the exhaust port of the standard cylinder.

Figure 15:
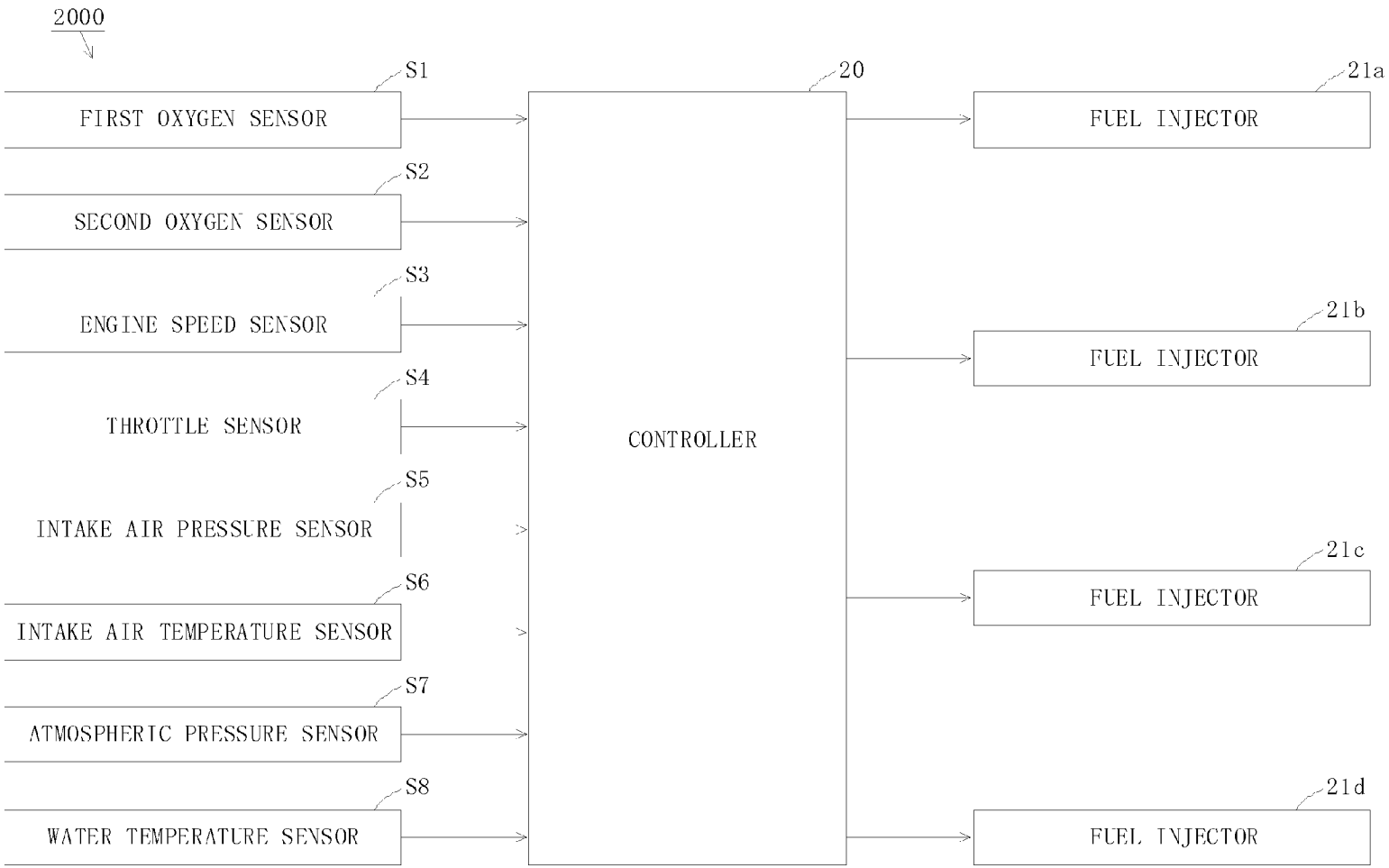
FIG. 15 is a block diagram showing one example of a control system of an exhaust system.

(c) Control of the Amount of Injected Fuel Based on the Output Value of the Sensor (c-1) Configuration of the Exhaust System FIG. 15 is a block diagram showing one example of a control system of an exhaust system according to the present preferred embodiment of the present invention.

As shown in FIG. 15, an exhaust system 2000 includes the first oxygen sensor S1, the second oxygen sensor S2, an engine speed sensor S3, a throttle sensor S4, an intake air pressure sensor S5, an intake air temperature sensor S6, an atmospheric pressure sensor S7, a water temperature sensor S8, a controller 20, and fuel injectors 21*a* to 21*d*. The controller 20 preferably includes, for example, a CPU (Central Processing Unit) and a storage device or a microcomputer. The fuel injectors 21*a* to 21*d* are provided in the cylinders of the engine 11, respectively.

The first oxygen sensor S1 detects the oxygen concentration of the gas exhausted from the standard cylinder. The second oxygen sensor S2 detects the oxygen concentration of the exhaust gases from all of the cylinders flowing into the coupling pipe 300C (refer to FIG. 5). The engine speed sensor S3 detects the speed of the engine 11. The throttle sensor S4 detects the throttle opening. The intake air pressure sensor S5 detects the intake air pressure. The intake air temperature sensor S6 detects the intake air temperature. The atmospheric pressure sensor S7 detects the atmospheric pressure. The water temperature sensor S8 detects the coolant temperature of the engine 11.

The values detected by the sensors S1 to S8 are input into the controller 20. The controller 20 calculates the amounts of injected fuel in the respective cylinders based on each of the input detected values, and controls the fuel injectors 21*a* to 21*d*, respectively.

(c-2) Method of Controlling the Amount of Injected Fuel

Hereinafter, a method of controlling the amounts of injected fuel in the respective cylinders by the controller 20 is described.

The controller 20, at first, calculates the standard amounts of injected fuel of the cylinders (herein after, referred to as a standard amount of injection), respectively, corresponding to driving conditions of the motorcycle 1000 (refer to FIG. 1), based on the IN throttle maps (refer to FIGS. 9A to 9D) and the IN boost maps (refer to FIGS. 10A to 10D) of the respective cylinders. The formula (1) mentioned below, for example, can be used for calculating the standard amount of injection.

$$IQs = P \times IQth + (1-P) \times IQbo \quad (1)$$

In the above formula (1), IQs indicates the standard amount of injection, IQth indicates the amount of injected fuel obtained from an IN throttle map, and IQbo indicates the amount of injected fuel obtained from an IN boost map. Furthermore, P satisfies the relationship of $0 \leqq P \leqq 1$ and is a factor that is determined based on the value detected by the engine speed sensor S3, the throttle sensor S4, or the intake air pressure sensor S5, for example.

In addition, the controller 20 calculates the air-fuel ratio of the standard cylinder based on the value detected by the first oxygen sensor S1, and the difference (herein after, referred to as a first air-fuel ratio error) between the calculated air-fuel ratio and the air-fuel ratio obtained from the target air-fuel ratio map (refer to FIGS. 7 and 8) is calculated. Moreover, the controller 20 calculates the air-fuel ratio of any of the cylinders based on the value detected by the second oxygen sensor S2, and the difference (herein after, referred to as a second air-fuel ratio error) between the calculated air-fuel ratio and the air-fuel ratio obtained from the target air-fuel ratio map is calculated.

When the switching output type oxygen sensor is used as the second oxygen sensor S2, the second oxygen sensor S2 is used to determine which is larger, the current air-fuel ratio of any of the cylinders or the target air-fuel ratio. Furthermore, as a target air-fuel ratio map used when the first and second air-fuel ratio errors are calculated, either or both of the A/F throttle map in FIG. 7 and the A/F boost map in FIG. 8 may be used.

The controller 20 determines the amount of correction to the amount of injected fuel in the standard cylinder based on the first and second air-fuel ratio errors such that the air-fuel ratio of the standard cylinder is equal to the target air-fuel ratio, for example, when the UEGO sensor is used as the second oxygen sensor S2. In addition, for example, when the switching output type oxygen sensor is used as the second oxygen sensor S2, the amount of correction to the amount of injected fuel in the standard cylinder is determined based on the first air-fuel ratio error and the determination by the second oxygen sensor S2. Then, the aforementioned standard amount of injection of the standard cylinder is corrected based on the determined amount of correction, thereby determining the amount of injected fuel in the standard cylinder. The amount of correction can be calculated, for example, using PID (Proportional Integral Differential) calculation based on the above error.

Furthermore, the controller 20 determines the amounts of correction to the amounts of injected fuel in the other cylinders based on the amount of correction of the standard cylinder. For example, if the amount of correction of the standard cylinder is 5% more than the standard amount of injection, the amounts of injected fuel are corrected respectively in the other cylinders so as to be 5% more than the standard amounts of injected fuel in the other cylinders, respectively.

Furthermore, the controller 20 may further correct the standard amount of injection based on the values detected by the intake air temperature sensor S6, the atmospheric pressure sensor S7, the water temperature sensor S8, and the like. This makes it possible to correct the standard amount of injection more accurately.

In addition, the second oxygen sensor S2 may be omitted. In this case, the amount of correction to the amount of injected fuel in the standard cylinder may be determined based on the first air-fuel ratio error.

(5) Effects of the Present Preferred Embodiment of the Present Invention

As mentioned above, in the exhaust system according to the present preferred embodiment of the present invention, the cylinder in which the amount of injected fuel is the closest to the average of the amounts of injected fuel in the plurality of cylinders of the engine 11 (four cylinders in this preferred embodiment), is regarded as a standard cylinder, and the air-fuel ratio of the standard cylinder is calculated by measuring the oxygen concentration of the gas exhausted from the standard cylinder by the first oxygen sensor S1. Then, the difference between the calculated air-fuel ratio of the standard cylinder and the target air-fuel ratio is calculated, and the fuel injector of the standard cylinder is controlled based on the calculated value such that the air-fuel ratio of the standard cylinder is equal to the target air-fuel ratio.

Furthermore, the air-fuel ratios of the cylinders other than the standard cylinder are regarded to be deviated from the target air-fuel ratio at the same rate as the air-fuel ratio of the standard cylinder, the amounts of correction of the respective cylinders are determined at the same rate as the amount of correction of the amount of injected fuel in the standard cylinder, and the fuel injectors of the respective cylinders are controlled. Accordingly, correction of the amounts of injected fuel in all of the cylinders can be implemented based on the result of detection by a single oxygen sensor.

Here, as mentioned above, the standard cylinder is the cylinder in which the amount of injected fuel is the closest to the average of the amounts of injected fuel in the plurality of cylinders. In this case, the amounts of correction of the other cylinders are determined based on the amount of correction of the standard cylinder, thereby making it possible to easily bring the air-fuel ratios of the other cylinders closer to the target air-fuel ratio. As a result of the foregoing, the purification efficiency of the catalyst can be enhanced at low cost.

Furthermore, in this preferred embodiment of the present invention, the second oxygen sensor S2 is provided at the portion (the coupling pipe 300C in FIG. 5) where the gases exhausted from the respective cylinders merge. In this case, the second oxygen sensor S2 can measure the oxygen concentration of the gases exhausted from all of the cylinders. That is to say, the air-fuel ratios of the cylinders excluding the standard cylinder can be detected by the second oxygen sensor S2. Accordingly, the amounts of injected fuel in the respective cylinders are controlled based on the result of detection by the second oxygen sensor S2 in addition to the result of detection by the first oxygen sensor S1, thereby making it possible to further surely bring the air-fuel ratios of the other cylinders closer to the target air-fuel ratio. This can further enhance the purification efficiency of the catalyst.

Moreover, the results of detection by the first oxygen sensor S1 and the second oxygen sensor S2 are compared with each other, thereby making it possible to discover problems with the first oxygen sensor S1 and the second oxygen sensor S2 earlier.

The second oxygen sensor S2 may be attached to the coupling pipe 300A or in the second exhaust pipe group 300 in FIG. 5. In this case, the oxygen concentration of the exhaust gas immediately after passing through the first catalyst device 200 can be detected, thereby improving the response of correction to the amount of injected fuel. This makes it possible to correct the amount of injected fuel more accurately.

In particular, when the second oxygen sensor S2 is attached to the side wall of the space through which the exhaust gas from the standard cylinder flows among the spaces 301*b* to 304*b* of the coupling pipe 300A or when the second oxygen sensor S2 is attached to the exhaust pipe through which the exhaust gas from the standard cylinder flows among the second exhaust pipe group 300, the oxygen concentration of the gas exhausted from the standard cylinder can be measured more accurately and the problems with the first oxygen sensor S1 can be discovered more reliably.

(6) Catalyst Device

It is preferable that an effective opening area of the catalyst 200A (refer to FIG. 4) is larger than a total cross-sectional area of the exhaust pipes 101, 102, 103, 104. The effective opening area of the catalyst 200A is now described with respect to FIG. 16.

Figure 16:
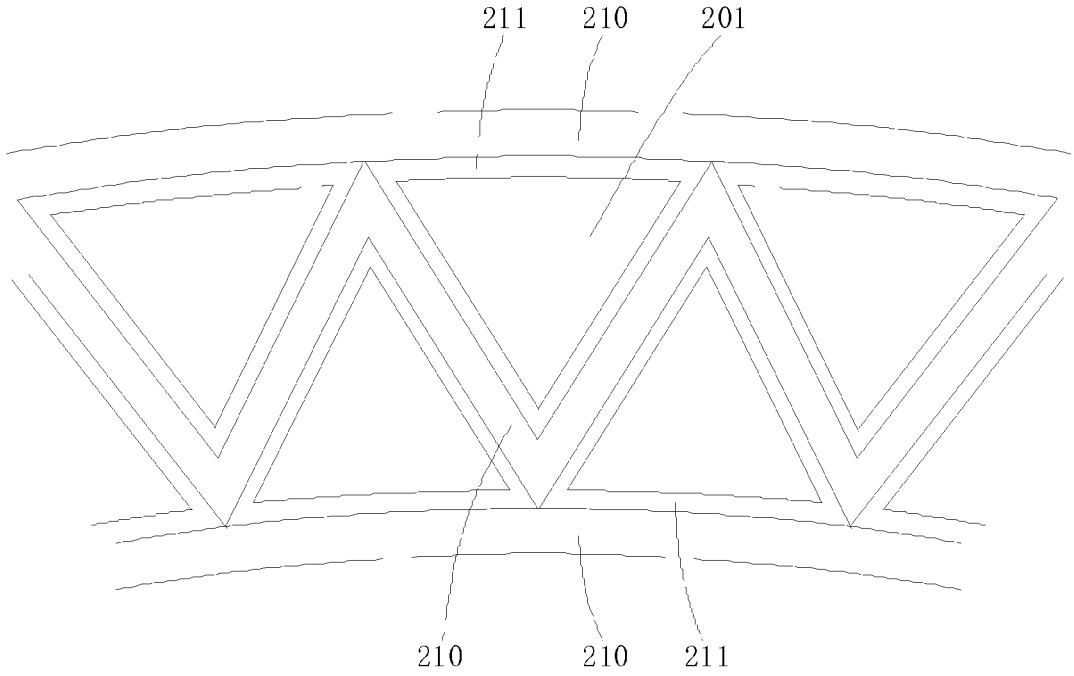
FIG. 16 is a view for explaining an effective opening area of a catalyst.

FIG. 16 is an enlarged schematic view of the flow paths 201 described in FIG. 4B. As described above, in this example, the three-way catalyst 200A obtained by applying catalyst metals to the substrate 210 having a plurality of openings each having a triangular cross section is preferably used. In this case, as shown in FIG. 16, the flow paths 201 are formed so as to be surrounded by the substrates 210 and metal catalytic layers 211 applied to the substrates. In this example, the cross-sectional shape of each of these flow paths 201 is approximately triangular to obtain an area thereof. A value calculated by multiplying the obtained area by the number of the flow paths 201 formed in the catalyst 200A is an effective opening area. More specifically, in this example, the effective opening area indicates an area of a portion that the exhaust gas can pass through in the catalyst 200A.

Accordingly, by making the effective opening area of the catalyst 200A larger than the total cross-sectional area of the exhaust pipes 101, 102, 103, 104, the exhaust gas flowing into the catalyst 200A can be efficiently passed through the catalyst 200A.

Figure 17:
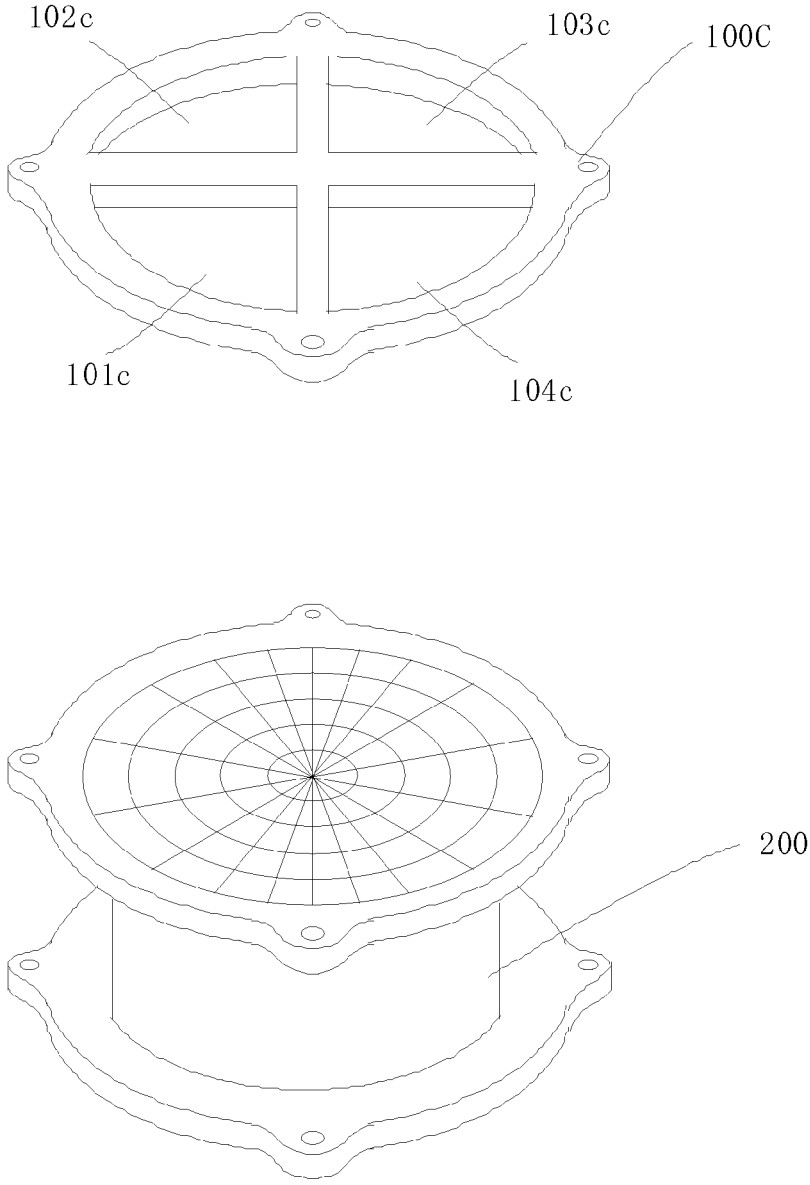
FIG. 17 is a view for explaining one example of a joining method of the first exhaust pipe group and the first catalyst device.

Furthermore, the joint between the first exhaust pipe group 100 and the first catalyst device 200 may be formed by using a flange member 100C with openings 101*c*, 102*c*, 103*c*, 104*c* as shown in FIG. 17. In this case, the respective exhaust pipes 101, 102, 103, 104 and the flange member 100C are welded such that the internal spaces of the respective exhaust pipes 101, 102, 103, 104 (refer to FIG. 3) communicate with the openings 101*c*, 102*c*, 103*c*, 104*c*, respectively. Furthermore, the joint between the first catalyst device 200 and the second exhaust pipe group 300 can be formed similarly.

Figure 18:
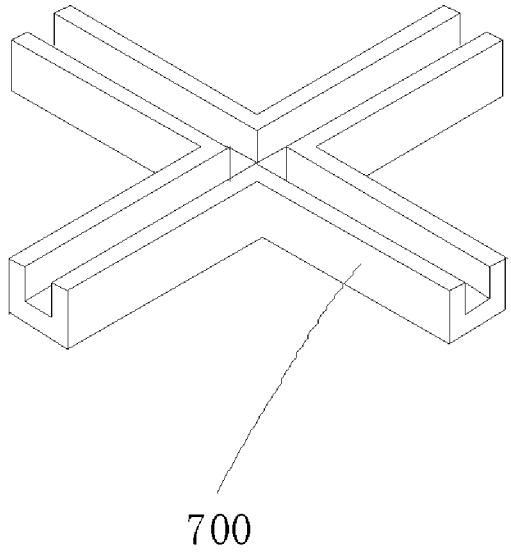
FIG. 18 is a view showing a fitting member.

Furthermore, cross-shaped fitting members 700 each having grooves as shown in FIG. 18 may be provided on both surfaces of the catalyst 200A, respectively. In this case, the first exhaust pipe group 100, the first catalyst device 200, and the second exhaust pipe group 300 are joined such that the partition plate 100B and the partition plate 300B fit into the grooves of the fitting members 700, respectively.

Furthermore, cross-shaped fitting grooves (not shown) may be provided on both surfaces of the catalyst 200A, respectively. In this case, the first exhaust pipe group 100, the first catalyst device 200, and the second exhaust pipe group 300 are joined such that the partition plate 100B and the partition plate 300B are fit into the fitting grooves, respectively.

Still furthermore, while in the above-described preferred embodiments, the plurality of flow paths 201 of the catalyst 200A are not in communication with each other, a portion of the plurality of flow paths 201 may be in communication with each other to such an extent that the pressure interference of the exhaust gas hardly occurs between the plurality of flow paths 201.

Furthermore, the structure of the joint portions of the first exhaust pipe group 100, the first catalyst device 200, and the second exhaust pipe group 300 is not limited to the above-described examples, but any other structure may be included as long as the exhaust gas pressure interference in the joint portions can be prevented or minimized.

Furthermore, the first catalyst device 200 and the second catalyst device 400 may be each formed into a rectangular column, and the coupling pipes 100A, 300A, 300C may be each formed into a hollow rectangular column.

The number of the muffler devices 600 is not limited to two, but may be changed as necessary according to the structure of the motorcycle 1000.

(7) Other Preferred Embodiments of the Present Invention

While in the above-described preferred embodiments a motorcycle with a four cylinder engine is described, the number of the cylinders of the engine is not limited to four, but the exhaust system of preferred embodiments of the present invention can be applied to an engine having any number of cylinders. For example, in the case of a six cylinder engine, six spaces may be provided in each of the coupling pipe 100A and the coupling pipe 300A, so that the exhaust gas pressure interference is prevented from occurring in the first exhaust pipe group 100, the first catalyst device 200, and the second exhaust pipe group 300 as in the above-described preferred embodiments.

More specifically, spaces corresponding to the respective exhaust pipes connected to the plurality of cylinders of the engine are preferably formed in the coupling pipe 100A and the coupling pipe 300A. This can prevent the exhaust gases from the plurality of cylinders from interfering with one another in the first exhaust pipe group 100, the first catalyst device 200, and the second exhaust pipe group 300. As a result, a reduction in the output performance of the engine at medium and low speeds due to exhaust gas pressure interference can be prevented.

Furthermore, regardless of the number of the cylinders, a standard cylinder is preferably determined as in the above-described preferred embodiments, and the first oxygen sensor S1 is preferably attached to the exhaust pipe connected to the standard cylinder.

Figure 19:
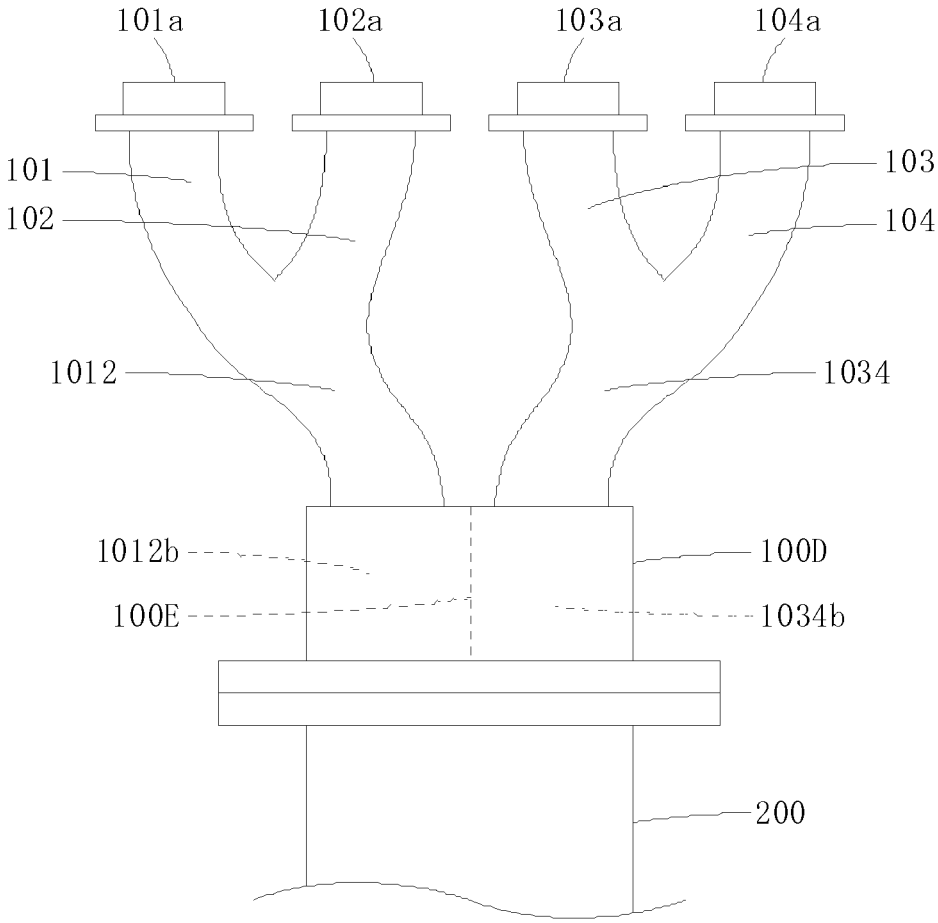
FIG. 19 is a view showing one example of an exhaust device.

In addition, while in the above-described preferred embodiments the case where the first exhaust pipe group 100 is composed of the same number of exhaust pipes as those of the cylinders of the engine 11 is described, the exhaust system of preferred embodiments of the invention can be applied to an exhaust device having the configuration in which the plurality of exhaust pipes 101 to 104 connected to the plurality of cylinders of the engine 11 are connected to a coupling pipe 100D after merging into the plurality of exhaust pipes that are not more than the number of cylinders, as shown in FIG. 19.

In the example of FIG. 19, the exhaust pipes 101 and 102 are connected to the coupling pipe 100D after merging into an exhaust pipe 1012 and the exhaust pipes 103 and 104 are connected to the coupling pipe 100D after merging into an exhaust pipe 1034, respectively. The coupling pipe 100D is connected to the first catalyst device 200. In addition, in the coupling pipe 100D, two spaces 1012*b* and 1034*b* are formed by a partition plate 100E indicated by the dotted line. Internal spaces of the respective exhaust pipes 1012 and 1034 communicate with the spaces 1012*b* and 1034*b*, respectively.

For example, when the exhaust pipe connected to the standard cylinder is the exhaust pipe 101, the first oxygen sensor S1 may be attached to a side of the coupling portion 101*a* of the exhaust pipe 101. In this case, the amounts of injected fuel in the respective cylinders may be controlled as in the above-described preferred embodiments.

Furthermore, the first oxygen sensor S1 may be attached to the exhaust pipe 1012 or to the portion that is a side wall of the space 1012*b* in the coupling pipe 100A. More specifically, the first oxygen sensor S1 may be provided at a position where the gas exhausted from the standard cylinder can be measured. In this case also, the amounts of injected fuel in the respective cylinders may be controlled as in the above-described preferred embodiments.

Furthermore, while in the above-described preferred embodiments, the case where the exhaust device 12 is applied to the motorcycle is described, the exhaust device 12 may be applied to another vehicle such as a four wheeled vehicle, a three wheeled vehicle, a watercraft such as a personal watercraft, a marine vessel such as a boat or ship, or any other suitable vehicle making use of an exhaust system.

(8) Correspondence Between Each Constituent Element of the Claims and Each Part of the Embodiment While herein after, a corresponding example between the respective components in the claims and the respective portions of the preferred embodiments is described, the present invention is not limited to the following examples.

In the above-described preferred embodiments, the exhaust pipes 101, 102, 103, 104 are examples of first exhaust pipes, the coupling pipe 100A, the flange member 100C or the exhaust pipes 1012 and 1034, and the coupling pipe 100D are examples of a first assembler, the spaces 101*b*, 102*b*, 103*b*, 104*b*, the openings 101*c*, 102*c*, 103*c*, 104*c*, the exhaust pipes 1012, 1034 or the spaces 1012*b*, 1034*b* are examples of first inflow portions, the first oxygen sensor S1 is an example of a first detector, the controller 20 is an example of a controller, the standard cylinder is an example of a cylinder in which the amount of injected fuel is the closest to the average of the amounts of injected fuel in a plurality of cylinders that each meet predetermined conditions, the exhaust pipes 301, 302, 303, 304 are examples of second exhaust pipes, the coupling pipe 300A is an example of a second assembler, the spaces 301*b*, 302*b*, 303*b*, 304*b* are examples of second inflow portions, the coupling pipe 300C is an example of a third assembler, the second oxygen sensor S2 is an example of a second detector, the coupling pipe 100A, 300A are examples of a cylindrical body, the partition plate 100B, 300B are examples of a partition, the rear wheel 10 is an example of a drive wheel, and the transmission 13, the drive shaft 14, the drive sprocket 15, the chain 16, and the rear-wheel sprocket 17 are examples of a transmission mechanism.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An exhaust system for exhausting gas from a plurality of cylinders of an engine, the exhaust system comprising:

a plurality of first exhaust pipes corresponding in number to the plurality of cylinders, into which the gas exhausted from the plurality of cylinders flows, respectively;

a first catalyst device having a first catalyst that cleanses the gas introduced from the plurality of first exhaust pipes;

a first assembler arranged to assemble and couple first ends of the plurality of first exhaust pipes to the first catalyst device;

a plurality of first inflow portions provided at the first assembler that allow the gas exhausted from the plurality of first exhaust pipes to flow into the first catalyst device;

a first detector provided in only one of the plurality of first exhaust pipes or only one of the plurality of first inflow portions and arranged to detect the information about an oxygen concentration of the gas exhausted from only a respective one of the plurality of cylinders; and a controller that controls the amounts of fuel injected in the plurality of cylinders, based on the information about the oxygen concentration detected by the first detector; wherein the first assembler is connected to the first catalyst device such that the plurality of first inflow portions are not in communication with each other;

the first exhaust pipe or the first inflow portion provided with the first detector is connected to the cylinder in which the amount of injected fuel is the closest to an average of the amounts of fuel injected in the plurality of cylinders; and the controller calculates the air-fuel ratio in the cylinder in which the amount of injected fuel is the closest to the average amount based on the information about the oxygen concentration detected by the first detector, and controls the amounts of fuel injected in the plurality of cylinders based on the difference between the calculated air-fuel ratio and a predetermined target air-fuel ratio.

2. The exhaust system according to claim 1, wherein the controller determines a standard amount of fuel injected in each of the plurality of cylinders based on the predetermined target air-fuel ratio, and an amount of correction to the standard amount of fuel injected in the cylinder in which the amount of injected fuel is the closest to the average amount is based on the difference between the calculated air-fuel ratio and the predetermined target air-fuel ratio such that the air-fuel ratio of the cylinder in which the amount of injected fuel is the closest to the average amount is equal to the predetermined target air-fuel ratio.

3. The exhaust system according to claim 2, wherein the controller determines the amount of correction to the standard amount of injected fuel in at least one of the other cylinders based on the determined amount of correction to the standard amount of fuel injected in the cylinder in which the amount of injected fuel is the closest to the average amount.

4. The exhaust system according to claim 1, further comprising:

a plurality of second exhaust pipes corresponding in number to the plurality of cylinders; and a second assembler arranged to assemble and couple first ends of the plurality of second exhaust pipes to the first catalyst device; wherein the plurality of first inflow portions of the first assembler corresponds in number to the plurality of first exhaust pipes;

the second assembler has a plurality of second inflow portions corresponding in number to the plurality of second exhaust pipes; and the second assembler is connected to the first catalyst device such that the plurality of second inflow portions are not in communication with one another, and the plurality of second inflow portions are arranged so as to be opposed to the plurality of first inflow portions, respectively, with the first catalyst device interposed therebetween.

5. The exhaust system according to claim 4, further comprising:

a third assembler that assembles second ends of the plurality of second exhaust pipes; and a second detector provided at the third assembler and arranged to detect the information about the oxygen concentration of the gas exhausted from the plurality of cylinders; wherein the controller controls the amounts of injected fuel in the plurality of cylinders based on the information about the oxygen concentration detected by the first detector and the information about the oxygen concentration detected by the second detector.

6. The exhaust system according to claim 5, further comprising:

a second catalyst device connected to the third assembler and having a second catalyst that cleanses the gases introduced through the plurality of second exhaust pipes.

7. The exhaust system according to claim 4, wherein the first assembler has a substantially cylindrical body and a partition that divides the inside of the substantially cylindrical body into the plurality of first inflow portions corresponding in number to the plurality of first exhaust pipes, and the second assembler has a substantially cylindrical body and a partition that divides the inside of the substantially cylindrical body into the plurality of second inflow portions corresponding in number to the plurality of second exhaust pipes.

8. The exhaust system according to claim 4, wherein an area of each first inflow portion is equal to an area of each second inflow portion opposed to the respective first inflow portion.

* * * * *